US007284740B2

(12) United States Patent
Padiak et al.

(10) Patent No.: US 7,284,740 B2
(45) Date of Patent: Oct. 23, 2007

(54) ROTATING SIGN MOUNT WITH AUTOMATIC RETURN

(75) Inventors: Scott Padiak, Winnetka, IL (US); Thomas M. Conway, Park Ridge, IL (US); Paul Charle Evans, Chicago, IL (US); John Robert Visk, Chicago, IL (US)

(73) Assignee: Cormark, Inc., Des Plaines, IL (US)

( * ) Notice: Subject to any disclaimer, the term of this patent is extended or adjusted under 35 U.S.C. 154(b) by 0 days.

(21) Appl. No.: 11/448,422

(22) Filed: Jun. 7, 2006

(65) Prior Publication Data

US 2007/0002436 A1 Jan. 4, 2007

Related U.S. Application Data

(62) Division of application No. 10/680,909, filed on Oct. 8, 2003, now Pat. No. 7,124,993.

(60) Provisional application No. 60/459,599, filed on Apr. 2, 2003, provisional application No. 60/492,032, filed on Aug. 1, 2003.

(51) Int. Cl.
*A47B 97/04* (2006.01)

(52) U.S. Cl. ..... 248/458; 248/240; 16/309

(58) Field of Classification Search ..... 16/232, 16/239, 254; 248/110
See application file for complete search history.

(56) References Cited

U.S. PATENT DOCUMENTS

| | | | | |
|---|---|---|---|---|
| 684,721 | A | 10/1901 | Roots | |
| 2,100,473 | A | 11/1937 | Ensslin | |
| 2,144,885 | A | 1/1939 | MacFadden | |
| 3,184,200 | A | 5/1965 | McDonnell | |
| 4,048,768 | A | 9/1977 | Good | |
| 4,391,020 | A | 7/1983 | Hsu | |
| 4,909,464 | A | 3/1990 | Levine et al. | |
| 6,086,033 | A | 7/2000 | Calleja | |
| 6,484,988 | B2 | 11/2002 | Conway et al. | |
| 2003/0070258 | A1 * | 4/2003 | Nhep et al. | 16/232 |
| 2003/0131445 | A1 | 7/2003 | Padiak et al. | |

* cited by examiner

*Primary Examiner*—Amy J. Sterling
(74) *Attorney, Agent, or Firm*—Welsh & Katz, Ltd.

(57) ABSTRACT

A system for mounting a sign or graphic display to a structure allows rotation of the graphic display and provides for automatic return to the initial orientation.

26 Claims, 23 Drawing Sheets

ROTATING SIGN MOUNT WITH AUTOMATIC RETURN

The present application is a divisional of application Ser. No. 10/680,909 filed on 8 Oct. 2003 now U.S. Pat. No. 7,124,993, and claims the benefit of the filing dates of provisional application Ser. No. 60/459,599 filed on 2 Apr. 2003 and of provisional application Ser. No. 60/492,032 filed on 1 Aug. 2003.

This invention pertains to a sign mounting system. More particularly, it pertains to a rotating sign-mount with an automatic return feature.

BRIEF DESCRIPTION OF THE DRAWINGS

The components in the figures are not necessarily to scale.

DETAILED DESCRIPTION OF SOME EMBODIMENTS

Figure 1:
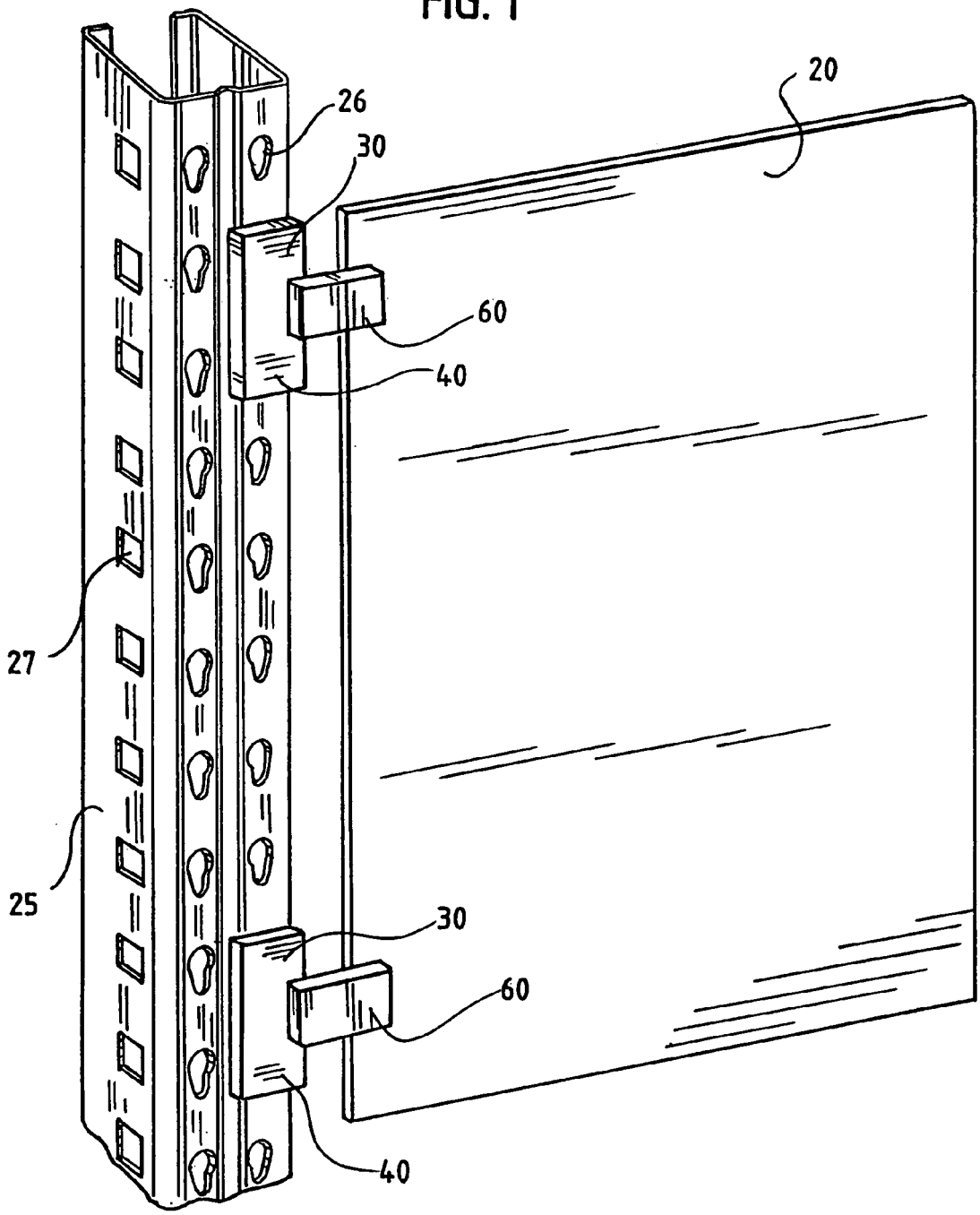
FIG. 1 is a perspective view of a sign mounted to a vertical structure in one simulated environment.

While the present invention is susceptible of embodiment in various forms, there is shown in the drawings and will hereinafter be described some embodiments with the understanding that the present disclosure is to be considered an exemplification of the invention and is not intended to limit the invention to the specific embodiments illustrated.

FIG. 1 is a perspective view showing an example of mounting elements 30 attaching a sign or graphic display 20 to a supporting structure 25. In the example of FIG. 1, graphic display 20 is attached by two mounting elements 30. In other examples, a different number of mounting elements 30 can be used.

In the example of FIG. 1, mounting elements 30 are mounted to the front of a vertical supporting structure 25. In other embodiments, the supporting structure need not be vertical, and the mounting elements 30 need not be mounted to the front of the supporting structure. For example, mounting elements 30 can be mounted to the side of a vertical supporting structure or to the top or bottom of a horizontal supporting structure, and so forth.

Figure 44:
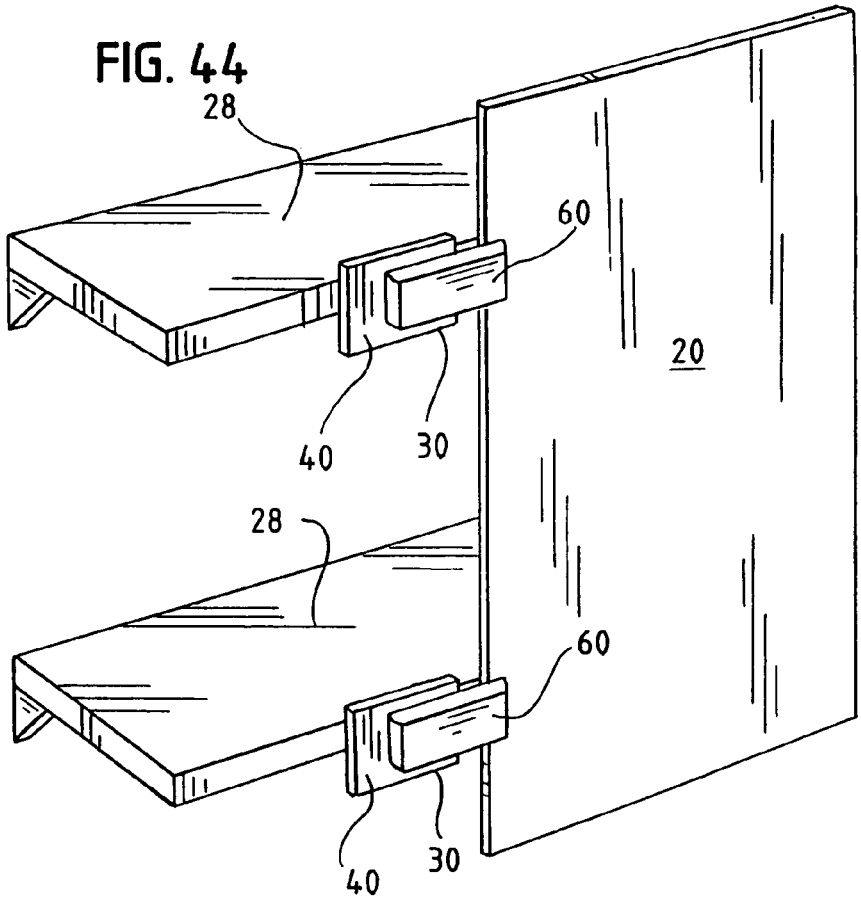
FIG. 44 is a perspective view of a sign mounted to the front of shelves in one simulated environment.
Figure 45:
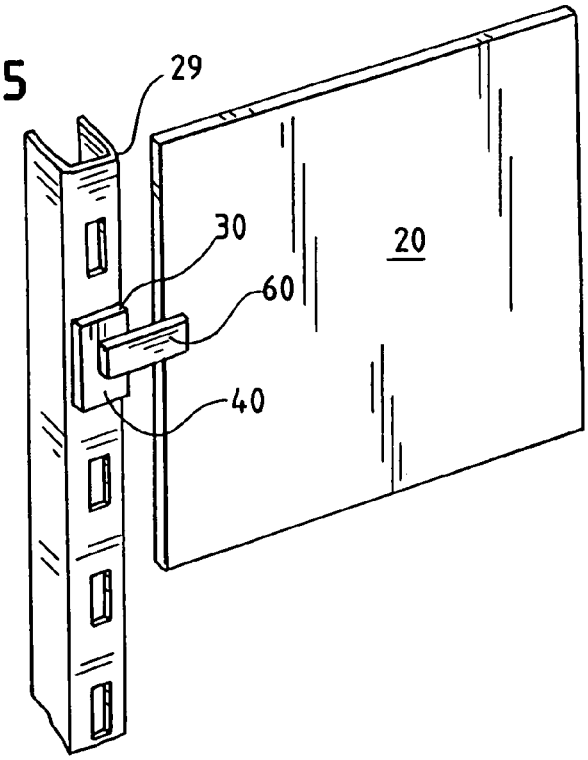
FIG. 45 is a perspective view of a sign mounted to a vertical structure in one simulated environment.

In the example of FIG. 44, mounting elements 30 are mounted to the front of shelves 28. In the example of FIG. 44, graphic display 20 is attached by two mounting elements 30. In the example of FIG. 45, mounting element 30 is mounted to vertical support structure 29, and graphic display 20 is attached by one mounting element 30.

In one example of an application, mounting elements 30 can be used to mount a graphic display 20 along shelving in warehouse-type store. In that environment, it is typical for the shelves to be supported by three-sided vertical supporting structure 25, with teardrop openings 26 on the front and square openings 27 on the sides.

Various embodiments of a mounting element 30 comprise a stationary portion 40 and a rotating portion 60. The stationary portion 40 and the rotating portion 60 are rotatably connected to each other so as to form an automatic return rotation hinge. That is, the rotating portion 60 easily can be rotated manually relative to the stationary portion 40. For example, it may be rotated to allow access to a shelf behind the graphic display 20 or to see what is displayed on the back of the graphic display 20. After being released, rotating portion 60 will then automatically rotate back to its initial stable orientation with respect to the stationary portion 40. A graphic display 20 can be secured to rotating portion 60 by adhesive, by clips, by hooks, by other fasteners, or by any of the myriad ways known to those skilled in the art.

Figure 25:
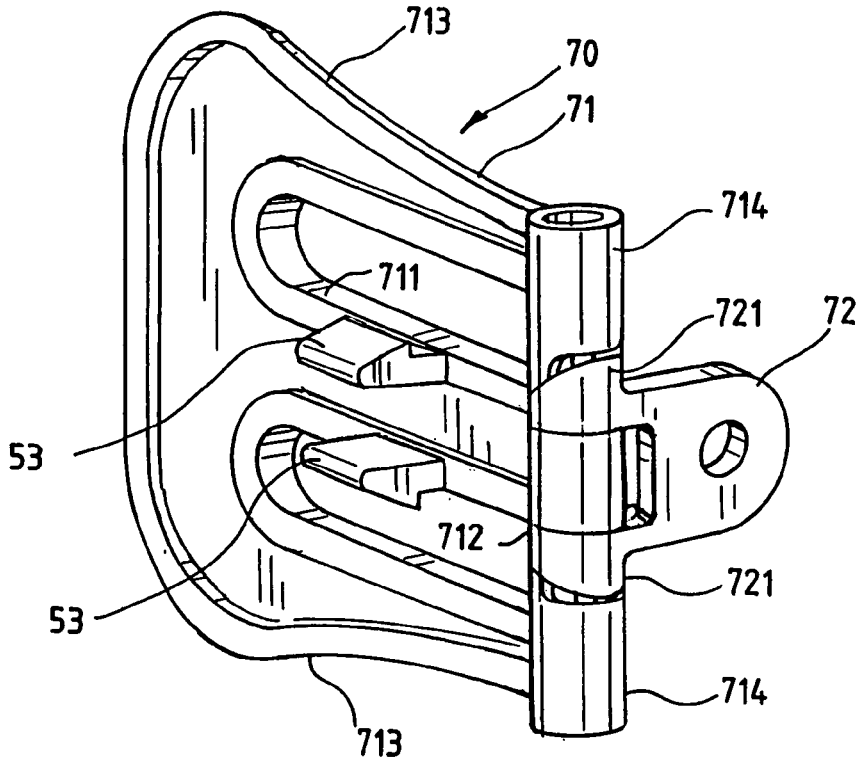
FIG. 25 is a perspective view of another embodiment of a mounting element in an initial orientation.
Figure 26:
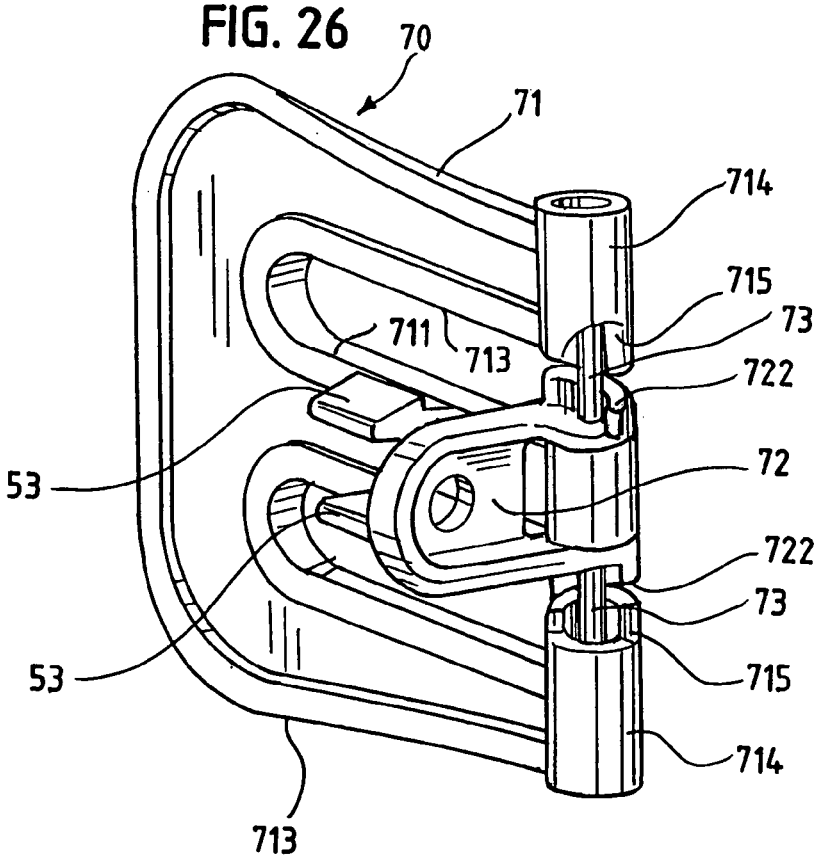
FIG. 26 is a perspective view of the embodiment of FIG. 25 after rotation.

Various means for automatically restoring the rotating portion to its initial stable orientation are described below, including for example a torsion spring, helical sliding surfaces, a bent arm spring, a cam and tongue arrangement, multiple hinge segments (such as illustrated in FIGS. 25 and 26), and cascaded rotating portions (such as illustrated, in FIGS. 40-43).

Stationary portion 40 and rotating portion 60 can be formed of materials and by processes known to those skilled in the art. For example, they can be formed of a plastic material and can be formed by an injection molding process. For example, polypropylene or high-density polyethylene can be used, particularly to provide resilence as required by some of the embodiments discussed below.

Different means for mounting the stationary portion to the supporting structure in either of at least two orientations with respect to the supporting structure are described below, including for example spring arms and mounting extensions.

Figure 2:
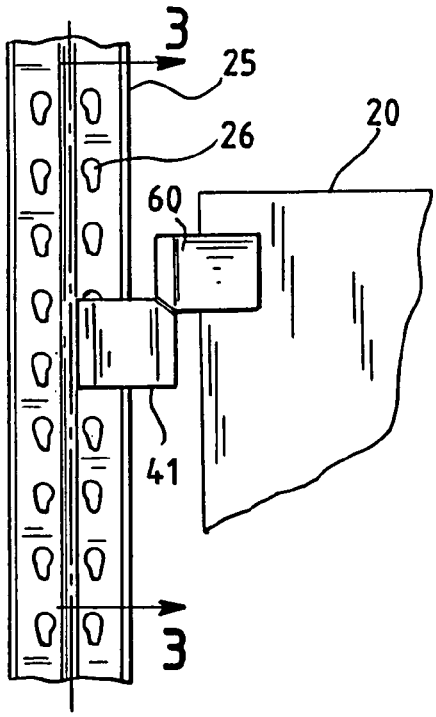
FIG. 2 is a front view of one embodiment of a mounting element in one simulated environment.
Figure 3:
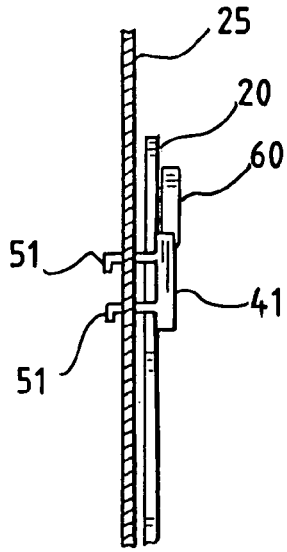
FIG. 3 is a cross-sectional side view taken along line 3-3 in FIG. 2.

Stationary portion 40 can be secured to a supporting structure such as supporting structure 25 by a variety of ways. In particular, it is preferable to secure stationary portion 40 to a supporting structure in a way in which it can be mounted and dismounted easily, without the need for tools, and without the need for separate fasteners. For example, FIG. 2 shows a front view of one embodiment, and FIG. 3 shows a cross-sectional side view taken along line 3-3 in FIG. 2. In the example of FIGS. 2 and 3, stationary portion 41 includes one or more hooks 51 which fit into teardrop openings 26 of a supporting structure 25. Supporting structure 25 is shown for demonstrative purposes, but the various examples discussed can be tailored to different support structures, such as shelves 28 or vertical support structure 29.

Figure 5:
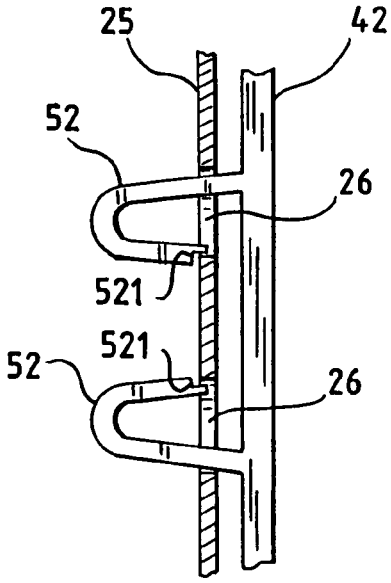
FIG. 5 is a cross-sectional side view taken along line 5-5 in FIG. 4.
Figure 4:
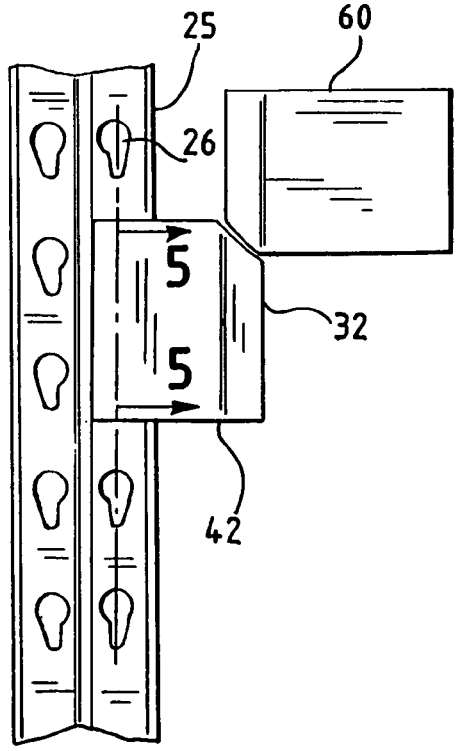
FIG. 4 is a front view of another embodiment of a mounting element in one simulated environment.

FIG. 4 shows a front view of another embodiment secured to a supporting structure 25. FIG. 5 is a cross-sectional side view taken along line 5-5 in FIG. 4. As seen in FIG. 5, stationary portion 42 includes spring arms 52 which can be snapped into openings 26 of supporting structure 25. Each spring arm 52 is fixed to and extends away from a remainder of stationary portion 42, and then bends in a generally opposite direction and ends with a free end. Notches 521 at the ends of springs arms 52 engage edges of two openings 26 to secure mounting element 32 to supporting structure 25. However, the spring arms 52 are flexible, and can be pushed apart for easy disengagement of a mounting element 32 from a supporting structure 25.

As seen in FIG. 5, spring arms 52 are mirror images of each other, so mounting element 32 can be rotated by 180° before being mounted on supporting structure 25. In the example of FIG. 5, the two different possible orientations of stationary portion 42 with respect to supporting structure 25 permit mounting of mounting element 32 either for automatic return rotation of rotating portion 60 to the left or for automatic return rotation to the right.

While the notches 521 of spring arms 52 of the example of FIGS. 4 and 5 engage edges of two openings 26, other arrangements can be used in other examples. For example, spring arms can be oriented differently and the notches can engage opposite edges of a single opening. In that case, the spring arms are pushed together for disengagement. In some other examples, there can be more than two spring arms possibly fitting through more than two openings, and so forth.

Figure 6:
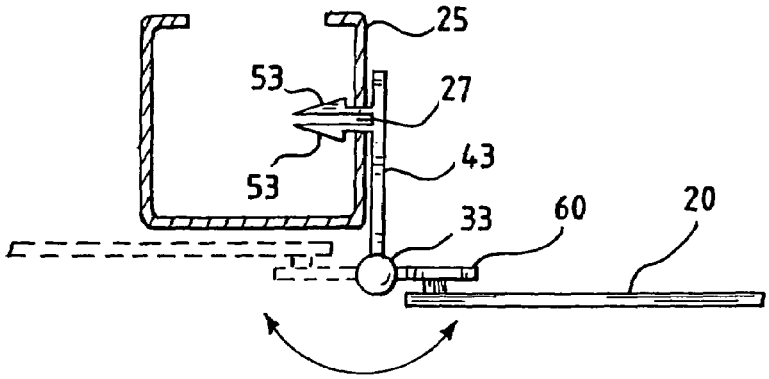
FIG. 6 is a top view of another embodiment of a mounting element in one simulated environment, with a graphic display rotated 180° shown in phantom.
Figure 7:
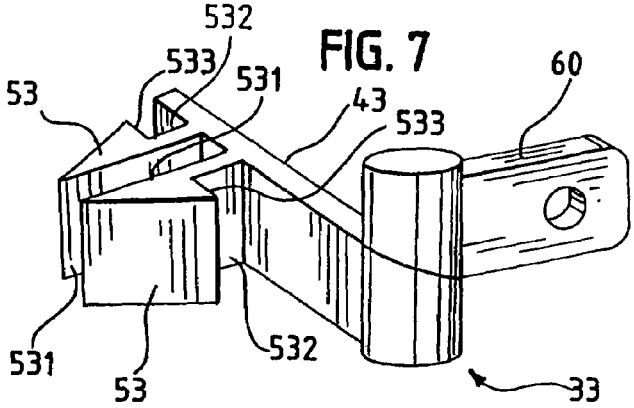
FIG. 7 is a perspective view of the embodiment of FIG. 6.

FIG. 6 shows a top view of another embodiment of a mounting element 33 secured through a square opening 27 on the side of a supporting structure 25. FIG. 7 shows a perspective view of mounting element 33. In the example of FIG. 7, stationary portion 43 includes a pair of mounting extensions 53. Each pair comprises two extensions 53, each of which comprises an inward surface 531 facing and spaced apart from an inward surface 531 of the other extension 53 of the pair. Each extension 53 also comprises an outward surface 532 which includes a lip 533. The inward surface 531 and outward surface 532 of an extension 53 are on the opposite sides of that extension 53. The two lips 533 of a pair of extensions 53 can engage opposite edges of an opening 27 to secure mounting element 33 to supporting structure 25. However, the extensions 53 are flexible, and can be pushed together for easy disengagement of a mounting element 33 from a supporting structure 25.

While the lips 533 of extensions 53 of the example of FIGS. 6 and 7 engage edges of one opening 27, other arrangements can be used in other examples. For example, extensions can be oriented differently and the lips can engage edges of two different openings. In some other examples, there can be more than two extensions fitting through more than two openings, and so forth.

Figure 8:
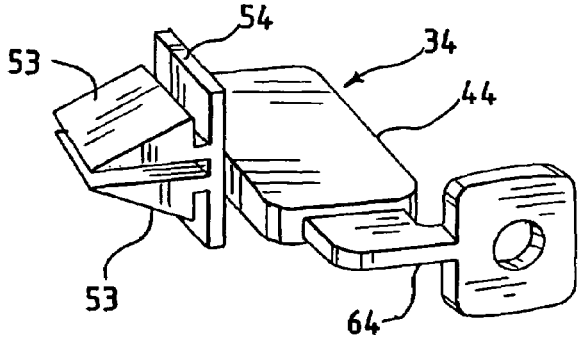
FIG. 8 is a perspective view of another embodiment of a mounting element.

FIG. 8 shows a perspective view of another embodiment of a mounting element 34. Mounting element 34 comprises stationary portion 44 and rotating portion 64, which are rotatably connected to form a cam and tongue arrangement discussed below. In the example of FIG. 8, stationary portion 44 includes a back plate 54 and extensions 53 similar to the extensions 53 of the embodiment of FIG. 7.

Figure 9:
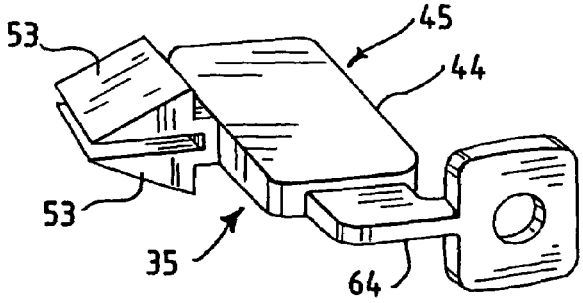
FIG. 9 is a perspective view of another embodiment of a mounting element.

FIG. 9 shows a perspective view of another embodiment of a mounting element 35. Mounting element 35 comprises stationary portion 45. In the example of FIG. 9, stationary portion 45 is similar to stationary portion 44 of the embodiment of FIG. 8 in that it connects with a rotating portion 64 and includes extensions 53. However, it does not include a back plate 54.

In every embodiment, a stationary portion 40 and a rotating portion 60 are rotatably connected to each other so as to form an automatic return rotation hinge. It is preferable to connect them to each other in a way which can be manufactured easily and inexpensively, which will endure for many rotations without failure, and in which the automatic return rotation hinge can operate when the mounting element 30 is mounted in either of at least two orientations with respect to the supporting structure 25. That is, it is desirable that a mounting element 30 be reversible in that it may be mounted, for example, either so that rotating portion 60 will rotate automatically to the left or so that it will rotate automatically to the right.

Figure 10:
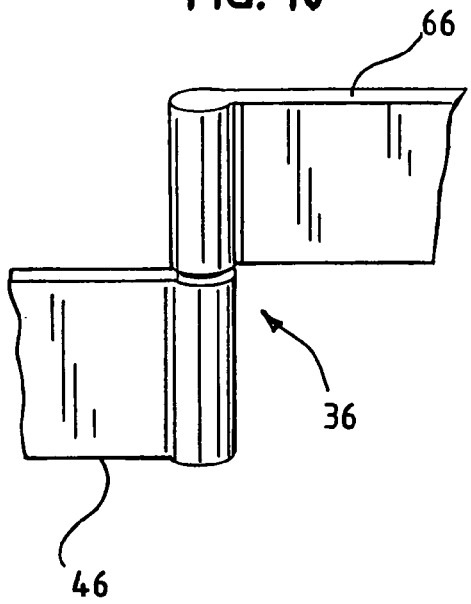
FIG. 10 is a partial perspective view of another embodiment of a mounting element.
Figure 11:
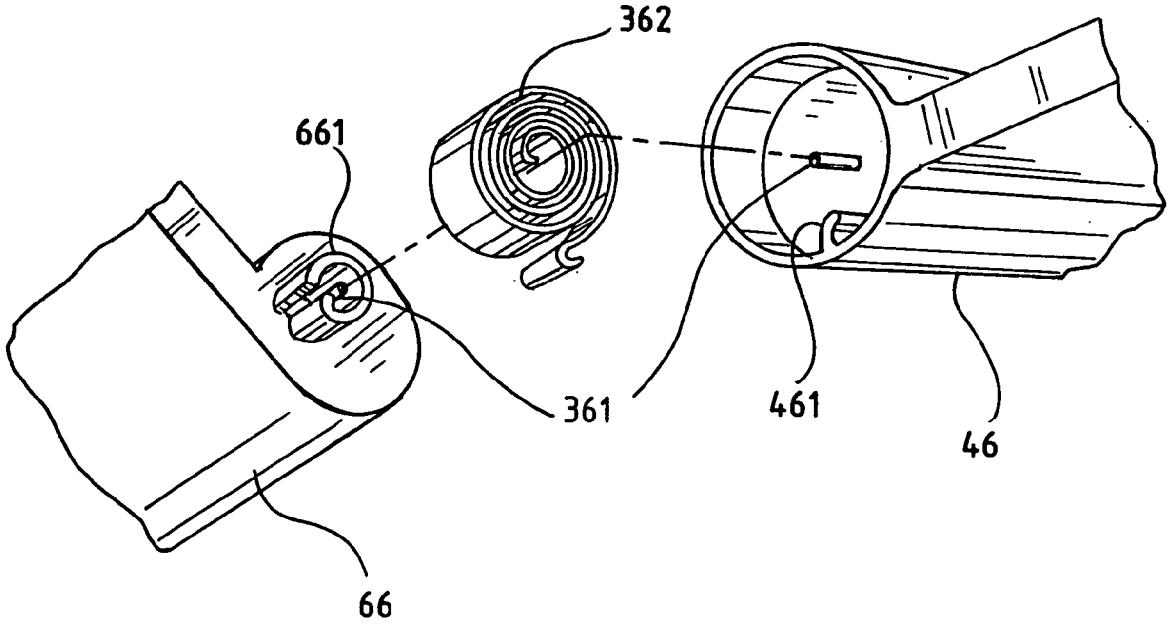
FIG. 11 is an exploded view of some components of the embodiment of FIG. 10.

FIG. 10 shows a partial perspective view of one embodiment of a mounting element 36, with stationary portion 46 and rotating portion 66. FIG. 11 shows an exploded view illustrating arrangement of some of the components. In the example of FIGS. 10 and 11, rotating portion 66 rotates relative to stationary portion 46 about hinge pin 361. In other examples, the stationary and rotating portions can be rotatably coupled without a hinge pin.

In the example of FIG. 11, rotating the rotating portion 66 puts torsion spring 362 in tension. Spring 362 can then automatically restore rotating portion 66 to its initial stable orientation. In the example of FIG. 11, one end of torsion spring 362 engages coupling element 661 extending down from rotating portion 66, and the other end of torsion spring 362 engages coupling element 461 of stationary portion 46.

In the example of FIG. 11, coupling element 661 of rotating portion 66 is an interior protrusion which extends down into and is surrounded by coupling element 461 of stationary portion 46. In other examples, there are other engagements with a torsion spring by the stationary and rotating portions such as, for example, the stationary portion engaging an interior end of the spring and the rotating portion engaging an exterior end of the spring.

Figure 12:
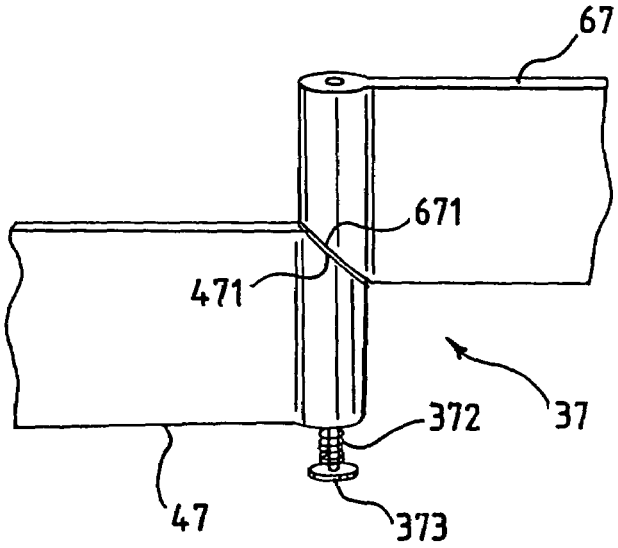
FIG. 12 is a partial perspective view of another embodiment of a mounting element.
Figure 13:
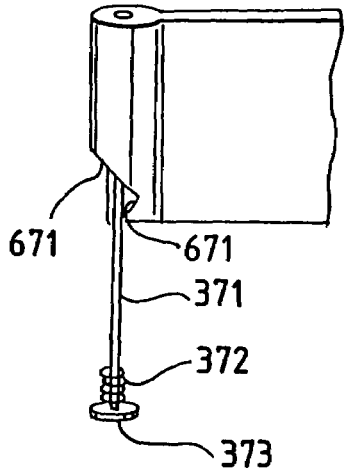
FIG. 13 is a partial perspective view of some components of the embodiment of FIG. 12.

FIG. 12 shows a partial perspective view of one embodiment of a mounting element 37, with a stationary portion 47 and a rotating portion 67. FIG. 13 is a partial perspective view without the stationary portion 47. In the example of FIGS. 12 and 13, rotating portion 67 rotates relative to stationary portion 47 about a hinge pin 371. In other examples, the stationary and rotating portions can be rotatably coupled without a hinge pin.

In the example of FIGS. 12 and 13, the stationary portion 47 and the rotating portion 67 slide against each other along helical sliding surfaces 471 and 671. In the example of FIGS. 12 and 13, longitudinal movement of hinge pin 371 through rotating portion 67 is limited so that as rotating portion 67 is rotated, the relationship of helical sliding surfaces 471 and 671 forces rotating portion 67 to pull hinge pin 371 longitudinally through stationary portion 47. Cap 373 is secured to an end of hinge pin 371, and spring 372 is positioned about hinge pin 371 between cap 373 and stationary portion 47. That is, in the example of FIGS. 12 and 13, spring 372 is compressed as rotating portion 67 is rotated. Compressed spring 372 can then automatically restore rotating portion 67 back to its initial stable orientation.

Many other embodiments can use a spring to cause automatic rotation back to a stable orientation. A spring can be positioned at different locations and/or it can be stretched during rotation instead of compressed, and so forth.

FIGS. 14 through 17 show an embodiment of a mounting element 38 which uses a bent arm spring 481. Mounting element 38 comprises stationary portion 48 and rotating portion 68. A graphic display 20 is secured to rotating portion 68. In the illustration of mounting element 38, stationary portion 48 is secured to supporting structure 25 using extensions 53, which are similar to extensions 53 discussed in connection with FIGS. 6 through 9. However, in other examples stationary portion 68 can be secured to a supporting structure in many other ways, such as those discussed above.

Figure 14:
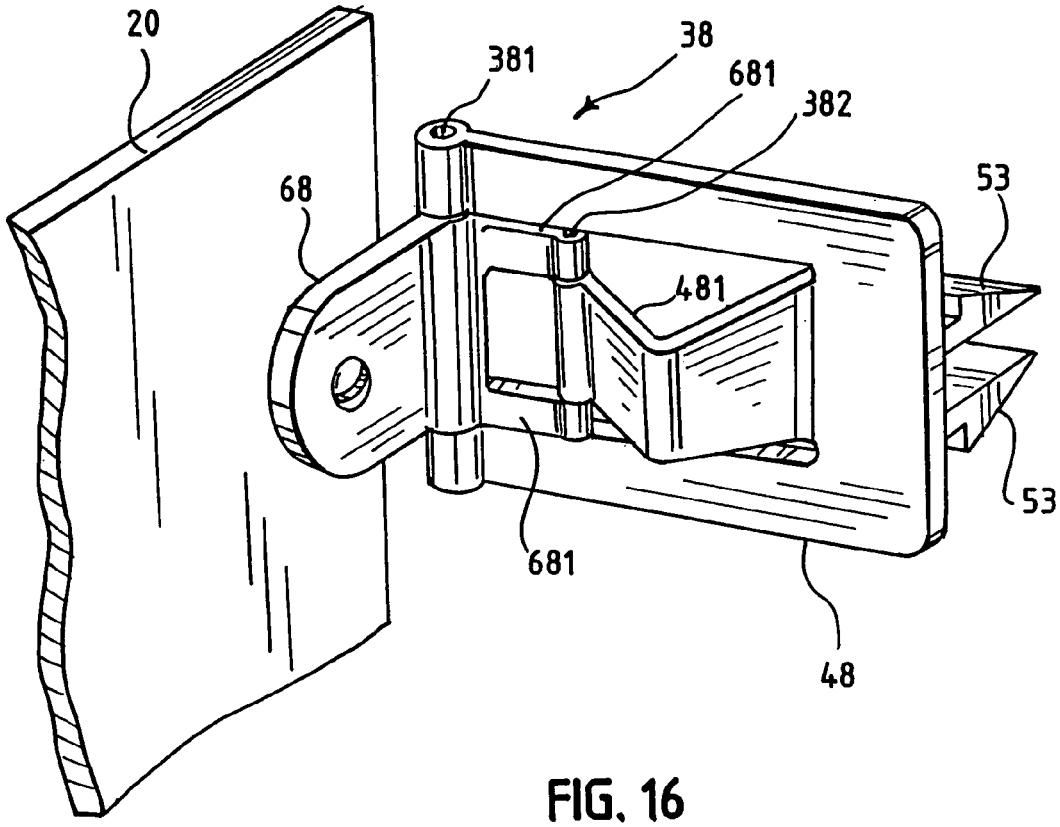
FIG. 14 is a perspective view of another embodiment of a mounting element in an initial orientation in one simulated environment.
Figure 16:
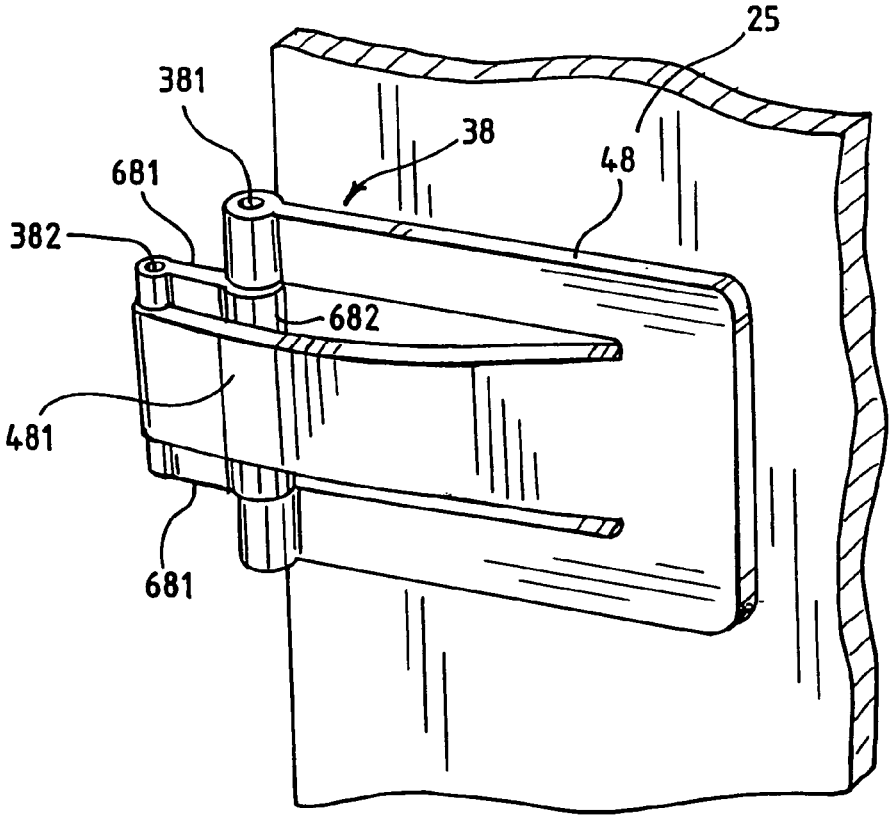
FIG. 16 is a perspective view of the embodiment of FIG. 14 after rotation in one simulated environment.
Figure 15:
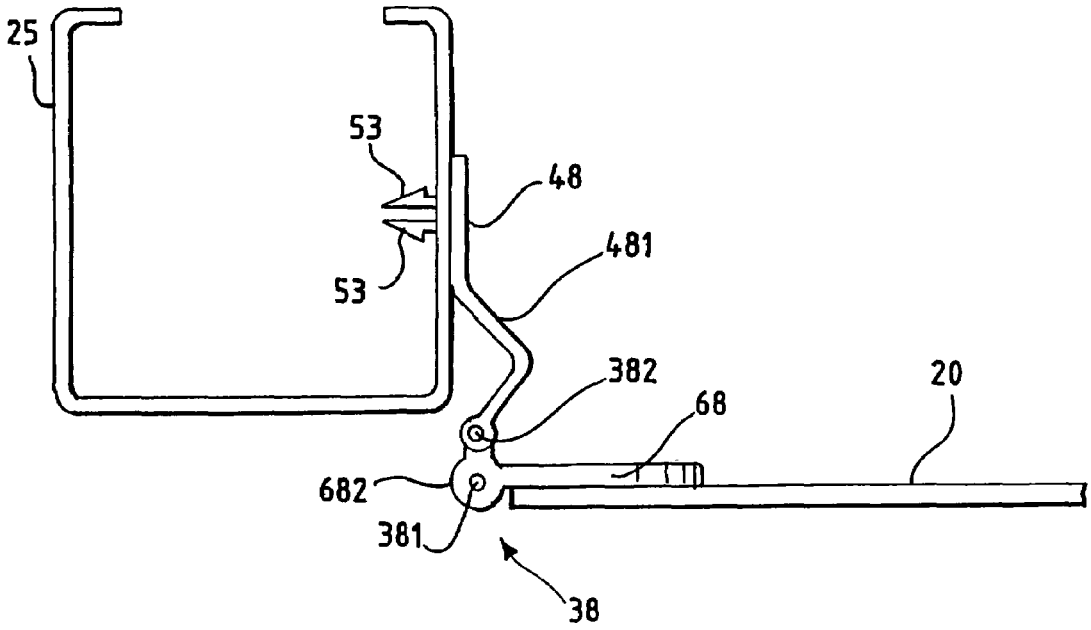
FIG. 15 is a top view of the embodiment of FIG. 14 in the initial orientation in one simualted environment.
Figure 17:
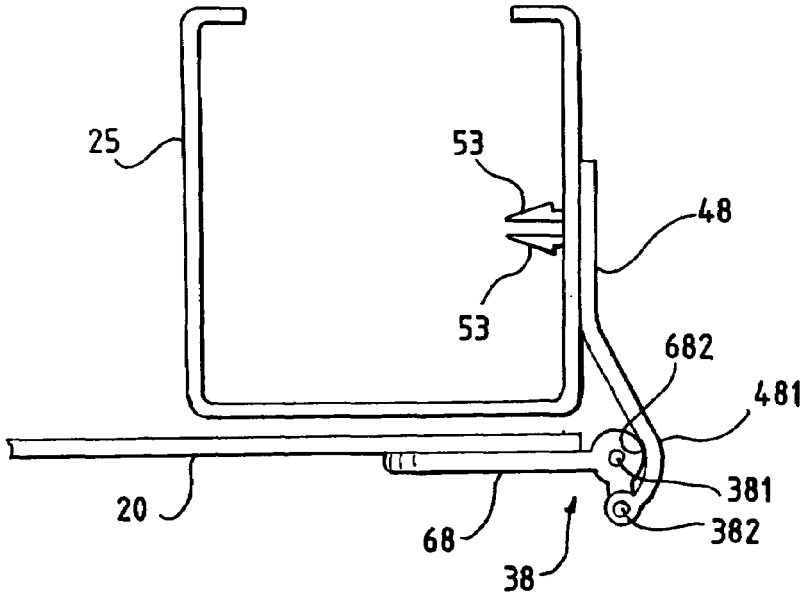
FIG. 17 is a top view of the embodiment of FIG. 14 after rotation in one simulated environment.

In the example of FIGS. 14 through 17, rotating portion 68 rotates relative to stationary portion 48 about a hinge pin 381. In other examples, the stationary and rotating portions can be rotatably coupled without a hinge pin. In the illustrated example, FIG. 14 shows a perspective view, and FIG. 15 shows a top view, in the initial stable orientation. FIG. 16 shows a perspective view, and FIG. 17 shows a top view, after rotation of the rotating portion 68.

In the illustrated example, stationary portion 48 includes bent arm spring 481. A fixed end of bent arm spring 681 is integral with stationary portion 48, a moving end of bent arm spring 481 is pivotally connected to extensions 681 of rotating portion 68 about pivot pin 382. In other examples, the ends of a bent arm spring can be coupled to the stationary and rotating portions in other ways. For example, a moving end of a bent arm spring can be coupled to the rotating portion without a pivot pin. In still other examples, a fixed end of a bent arm spring can be integral with the rotating portion, and a moving end of the bent arm spring can be coupled to the stationary portion, such as with a pivot pin.

When the rotating portion 68 is rotated about hinge pin 381 in the illustrated example, pivot pin 382 stretches out bent arm spring 481 putting it in tension. The arm spring 481 can then automatically restore rotating portion 68 back to its initial stable orientation. In other examples, a bent arm spring can be put in tension in other ways, such as by bending it instead of stretching it.

In the illustrated example, rotating portion 68 includes a knuckle 682 around hinge pin 381. When bent arm spring 481 is stretched out, it wraps over knuckle 682 and alleviates any tendency to over-center. In an over-center condition, arm spring 481 would tend to keep rotating portion 68 in its fully rotated orientation rather than automatically restoring it to its initial stable orientation. There can be other combinations of features in other examples. For example, there need not be a knuckle, there can be a knuckle without a hinge pin, the knuckle can be part of the stationary portion rather than the rotating portion as illustrated, and so forth.

FIGS. 18 through 24 show an embodiment of a mounting element 39 which uses a cam and tongue arrangement. Mounting element 39 comprises stationary portion 49 and rotating portion 64. Rotating portion 64 is similar to rotating portion 64 of the embodiments of FIGS. 8 and 9. A graphic display 20 is secured to rotating portion 64. In the illustration of mounting element 39, stationary portion 49 is secured to supporting structure 25 using extensions 53, which are similar to extensions 53 discussed in connection with FIGS. 6 through 9. However, in other examples stationary portion 49 can be secured to a supporting structure in many other ways, such as those discussed above.

Figure 18:
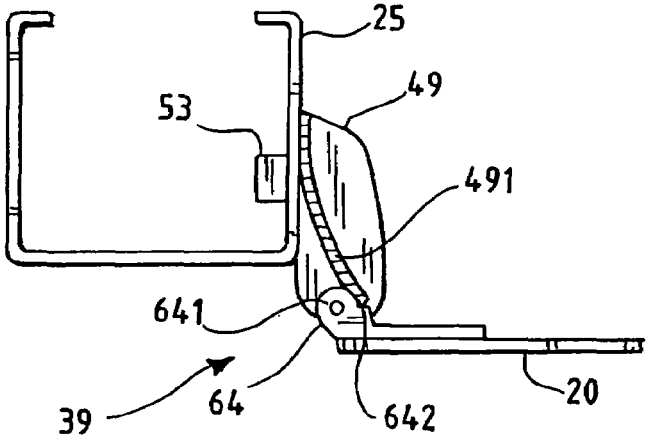
FIG. 18 is a top view of another embodiment of a mounting element in an initial orientation in one simulated environment.
Figure 19:
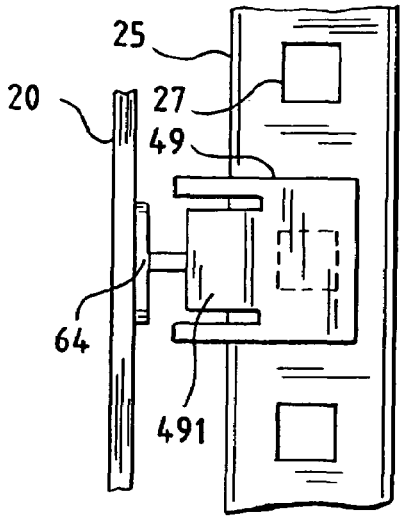
FIG. 19 is a side view of the embodiment of FIG. 18 in the initial orientation in one simulated environment.
Figure 20:
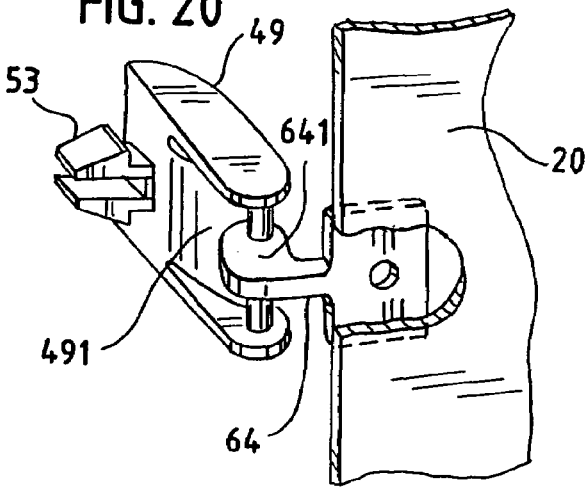
FIG. 20 is a perspective view of the embodiment of FIG. 18 in the initial orientation in one simulated environment.
Figure 21:
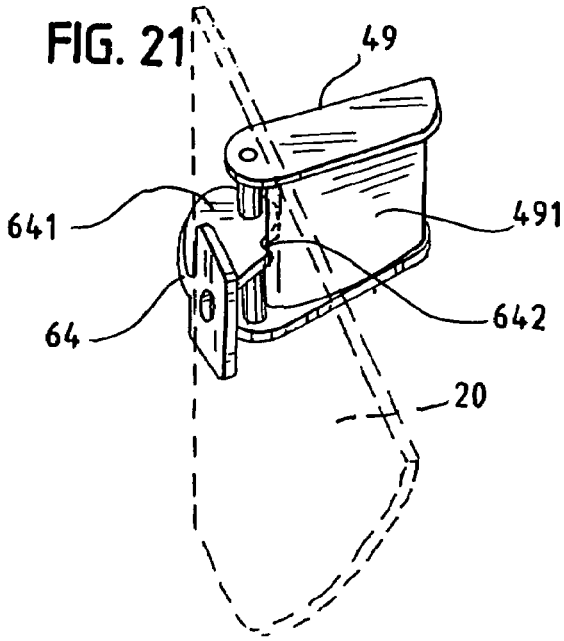
FIG. 21 is another perspective view of the embodiment of FIG. 18 in the initial orientation in one simulated environment.
Figure 22:
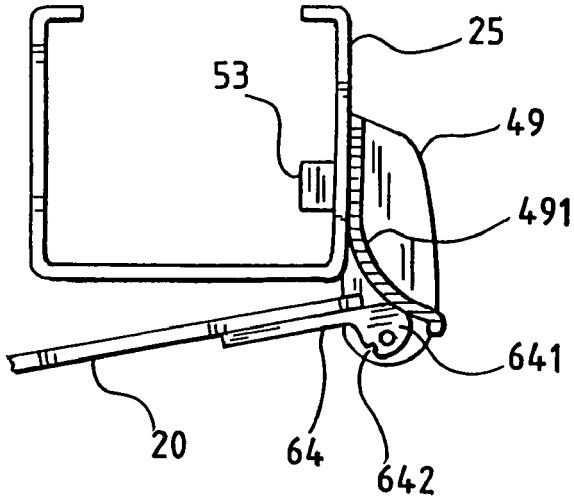
FIG. 22 is a top view of the embodiment of FIG. 18 after rotation in one simulated environment.
Figure 23:
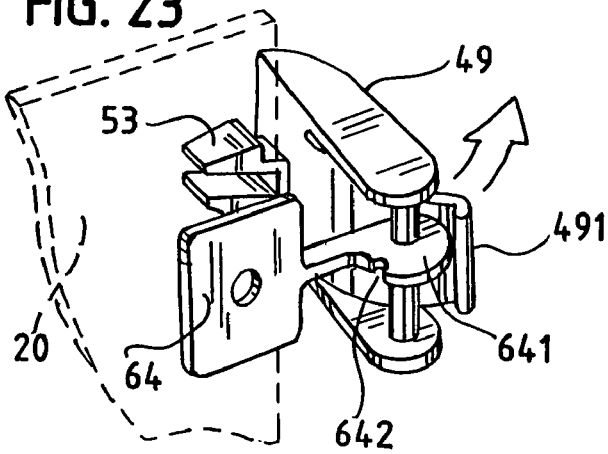
FIG. 23 is a perspective view of the embodiment of FIG. 18 after rotation in one simulated environment.
Figure 24:
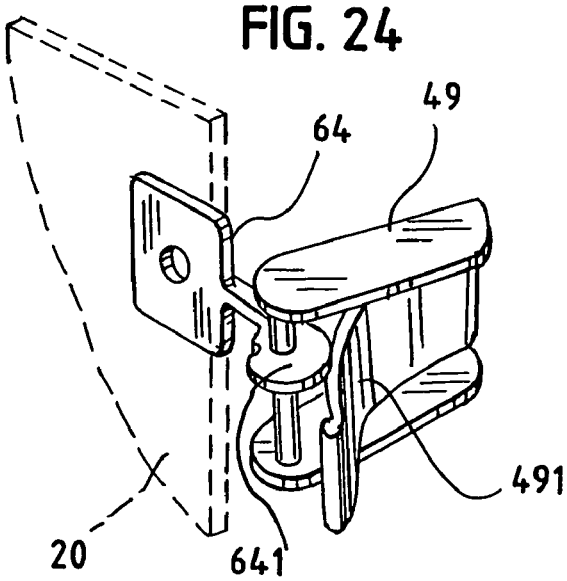
FIG. 24 is another perspective view of the embodiment of FIG. 18 after rotation in one simulated environment.

FIG. 18 shows a top view, and FIG. 19 shows a side view, of mounting element 39 mounted to supporting structure 25, with rotating portion 64 in its initial stable orientation. FIGS. 20 and 21 show two different perspective views of mounting element 39 in its initial stable orientation, and graphic display 20 is shown secured to rotating portion 64. FIG. 22 shows a top view of mounting element 39, mounted to supporting structure 25, after rotation of rotating portion 64. FIGS. 23 and 24 show two different perspective views of mounting element 39 after rotation of rotating portion 64.

In the illustrated example, rotating portion 64 comprises cam 641, and stationary portion 49 comprises flexible tongue 491. In other examples the rotating portion can comprise a flexible tongue, and the stationary portion can comprise a cam.

When rotating portion 64 is rotated from its initial stable orientation in the illustrated example, the shape of cam 641 causes tongue 491 to flex outward, putting tongue 491 in tension. Flexible tongue 491 can then push cam 641 to rotate in the opposite direction, automatically restoring rotating portion 64 back to its initial, stable orientation. In the illustrated example, an edge of cam 641 includes a notch 642 in which a tip of tongue 491 fits when rotating portion 64 is in its initial stable orientation.

FIGS. 25 and 26 illustrate another embodiment of a mounting element 70, comprising stationary portion 71 and rotating portion 72. FIG. 25 shows a perspective view in the initial stable orientation, and FIG. 26 shows a perspective view after rotation of rotating portion 72. In the illustrated example of mounting element 70, stationary portion 71 is shown with extensions 53 for securing mounting element 70 to a supporting structure. Extensions 53 of FIGS. 25 and 26 are similar to extensions 53 discussed in connection with FIGS. 6 through 9. However, in other examples stationary portion 71 can be secured to a supporting structure in many other ways, such as those discussed above.

In the example of FIGS. 25 and 26, stationary portion 71 comprises a middle prong 711 and two outer prongs 713, with middle hinge segment 712 at the end of prong 711 and an outer hinge segment 714 at the end of each prong 713. Extensions 53, which secure stationary portion 71 to a supporting structure, extend from middle prong 711 but can be located elsewhere in other examples.

In the illustrated example, rotating portion 72 comprises two rotating hinge segments 721, each one of which fits between middle hinge segment 712 and one of the outer hinge segments 714, respectively. Each outer hinge segment 714 slides against a rotating hinge segment 721 along helical sliding surfaces 715 and 722.

In the illustrated example, rotating portion 72 rotates about hinge pin 73. In other examples, the stationary and rotating portions can be rotatably coupled without a hinge pin. In the illustrated example, the middle of hinge pin 73 is secured within middle hinge segment 712, but outer hinge segments 714 are free to move longitudinally along the axis of hinge pin 73. As rotating portion 72 is rotated, the relationship of helical sliding surfaces 715 and 722 force outer hinge segments 714 to move outward relative to middle hinge segment 712. When rotating portion 72 is rotated and outer hinge segments 714 move outward, outer prongs 713 also spread outward from middle prong 711. The spring force of temporarily deformed stationary portion 71 will then tend to return stationary portion 71 to its initial stable shape. This will move outer hinge segments 714 back toward middle hinge segment 712, and helical sliding surfaces 715 and 722 sliding against each other will automatically restore rotating portion 72 back to its initial stable orientation.

In other examples, a hinge pin can be secured differently such as, for example, to one or both of the rotating hinge segments or to one of the outer hinge segments, as long as an outer hinge segment can move outward relative to the middle hinge segment. In still other examples, there can be a different number of prongs. For example, there can be more inner hinge segments or, for example, a stationary portion can have only two prongs with outer hinge segments on either side of a single rotating hinge segment. Spring action can result from the two prongs of the stationary portion being forced apart. In still other examples, spring action can result from prongs of the rotating portion being forced apart.

Figure 27:
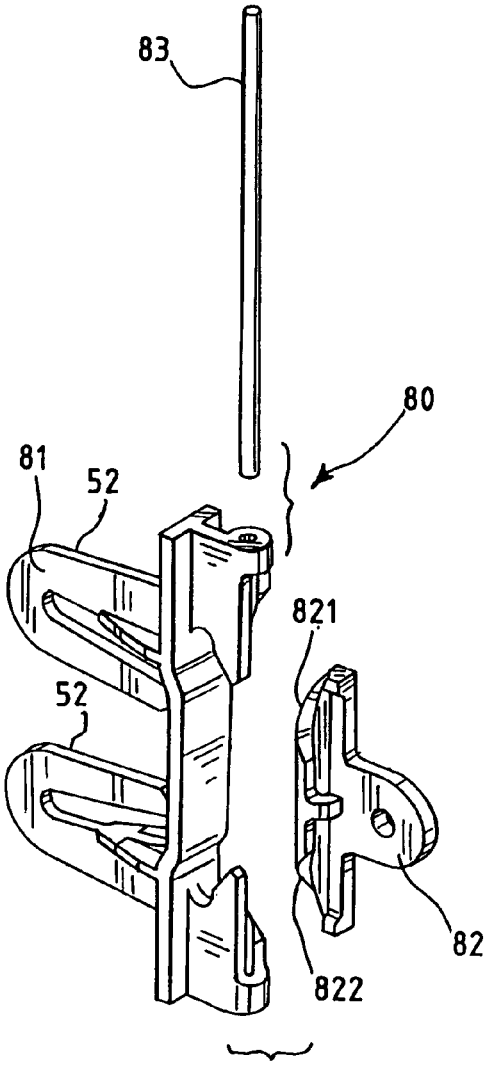
FIG. 27 is an exploded perspective view of another embodiment of a mounting element.
Figure 28:
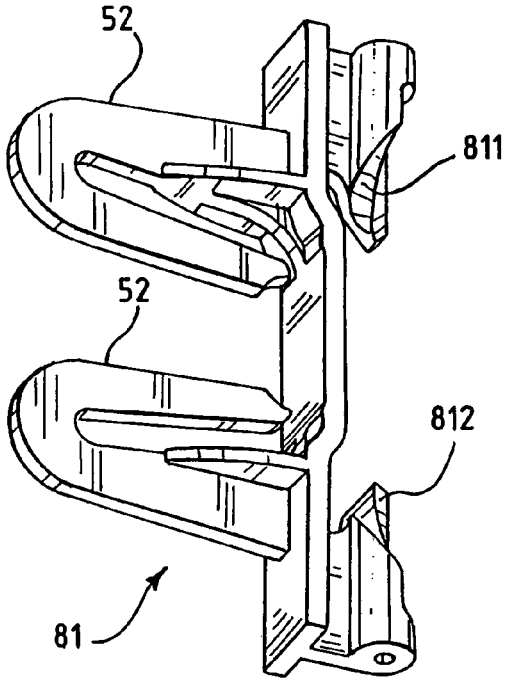
FIG. 28 is a perspective view of a stationary portion of the embodiment of FIG. 27.
Figure 29:
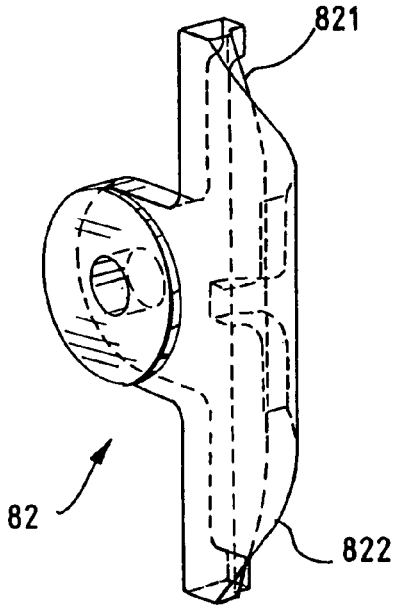
FIG. 29 is a perspective view of a rotating portion of the embodiment of FIG. 27.

FIG. 27 shows an exploded perspective view of one embodiment of mounting element 80, comprising stationary portion 81, rotating portion 82, and hinge pin 83. FIG. 28 shows a different perspective view of stationary portion 81, and FIG. 29 shows a different perspective view of rotating portion 82. In the illustration of mounting element 80, stationary portion 81 is shown with spring arms 52 for securing mounting element 80 to a supporting structure. Spring arms 52 of FIGS. 27 and 28 are similar to spring arms 52 discussed in connection with FIGS. 4 and 5. However, in other examples, stationary portion 81 can be secured to a supporting structure in many other ways, such as those discussed above.

Unlike those embodiments which use some kind of spring force to provide the automatic return rotation feature, mounting element 80 uses gravity to achieve automatic return rotation. In the illustrated example, stationary portion 81 comprises opposite stationary helical sliding surfaces 811 and 812, and rotating portion 82 comprises opposite rotating helical sliding surfaces 821 and 822. In the illustrated example, stationary sliding surfaces 811 and 812 are spaced apart from each other a greater distance than rotating sliding surfaces 821 and 822 are spaced apart from each other. Therefore, either sliding surfaces 811 and 821 can slide against each other, or sliding surfaces 812 and 822 can slide against each other, depending on which side of mounting element 80 is lower.

Regardless which two of the helical sliding surfaces are engaged in the illustrated example, the relationship of the helical sliding surfaces will force rotating portion 82 to rise as it rotates. Consequently, rotating portion 82 will slide back down due to gravity, rotating in the other direction to its initial stable orientation.

In the illustrated example, mounting element 80 comprises two pair of helical sliding surfaces for reversibility, but there can be two rather than four engageable sliding surfaces in other examples. In still other examples, rotating sliding surfaces can be spaced apart from each other a greater distance than stationary sliding surfaces are spaced apart from each other.

Figure 30:
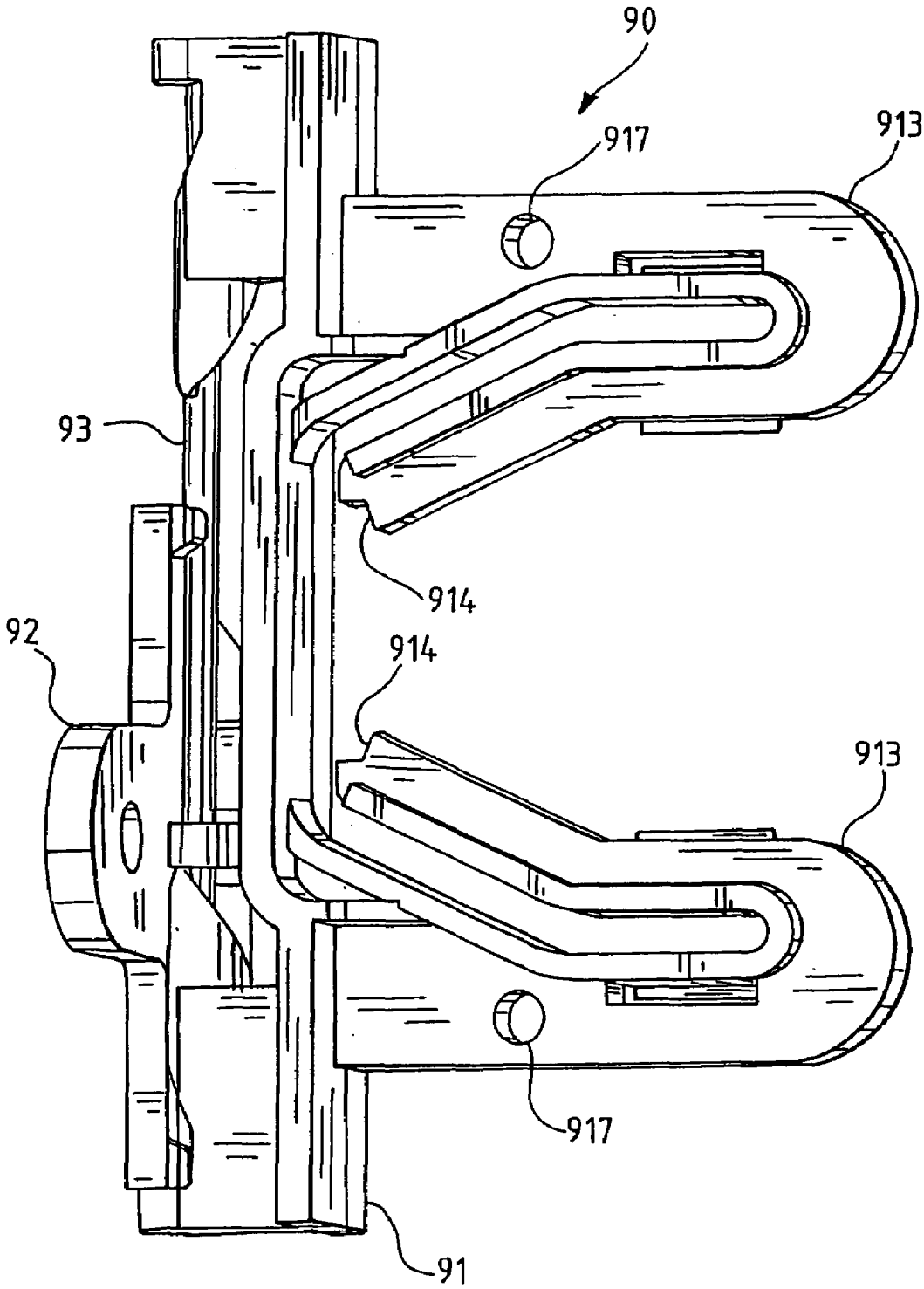
FIG. 30 is a perspective view of another embodiment of a mounting element in an initial orientation.
Figure 31:
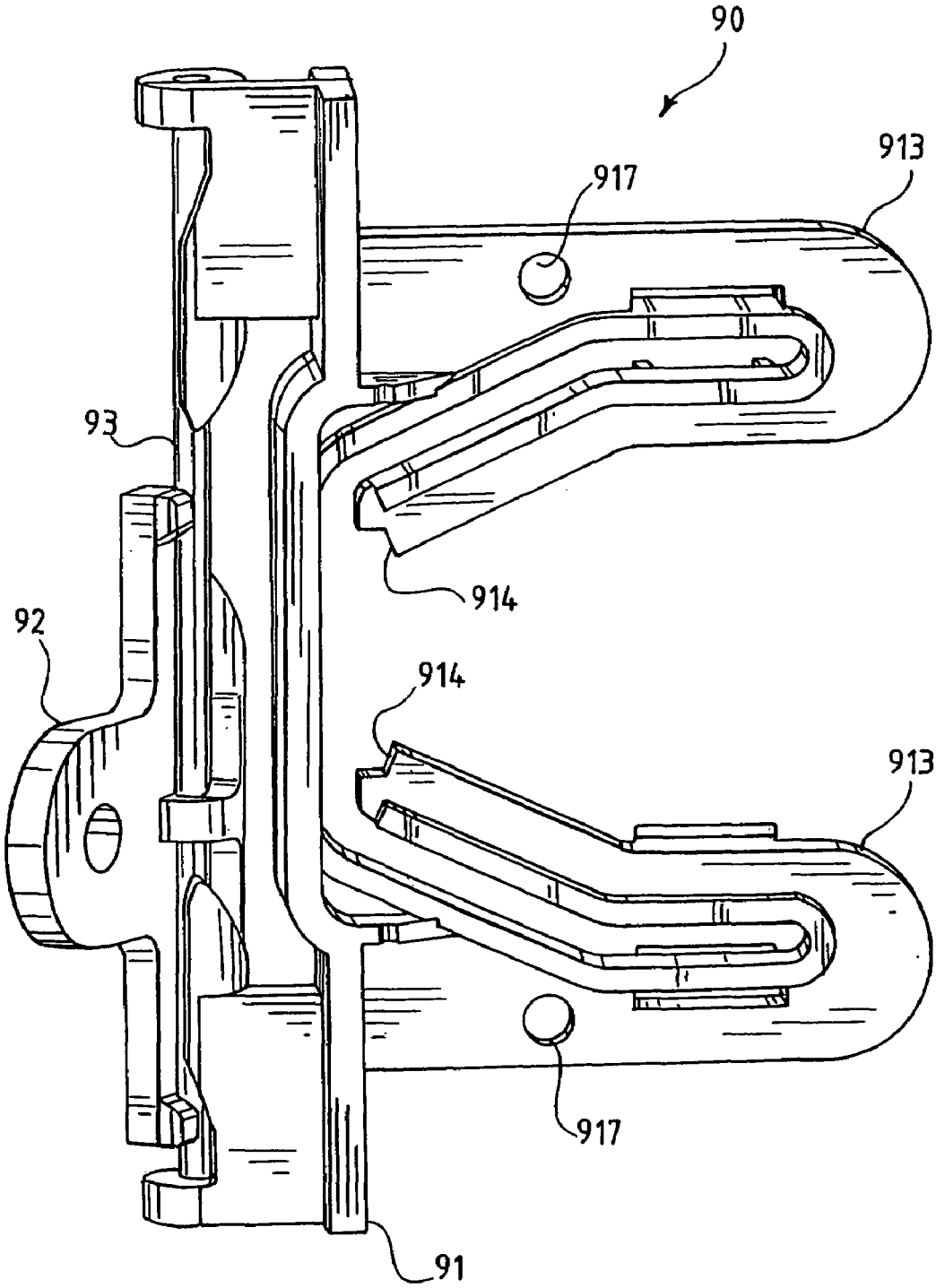
FIG. 31 is a perspective view of the embodiment of FIG. 30 after some rotation.
Figure 32:
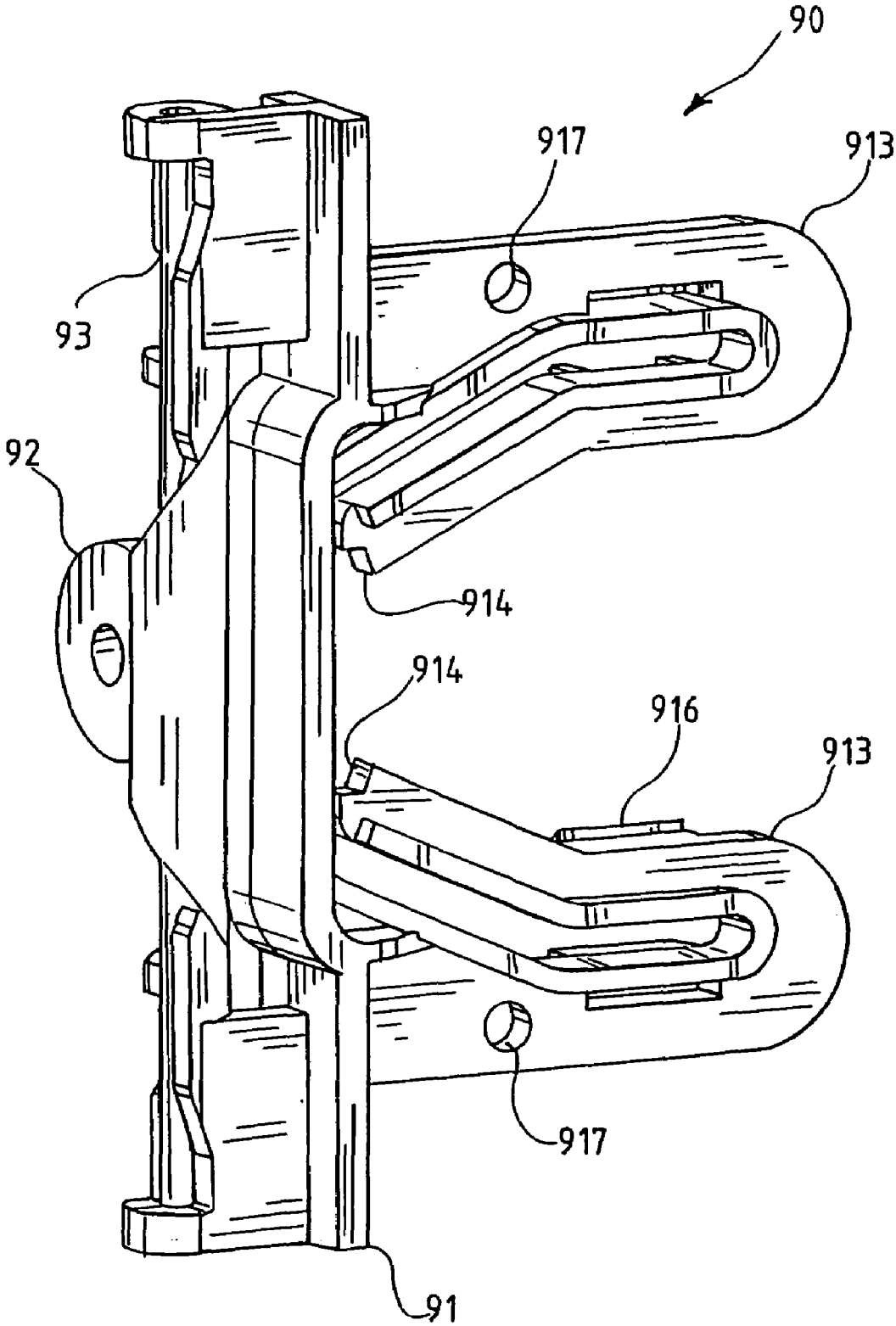
FIG. 32 is a perspective view of the embodiment of FIG. 30 after more rotation in the same direction.
Figure 33:
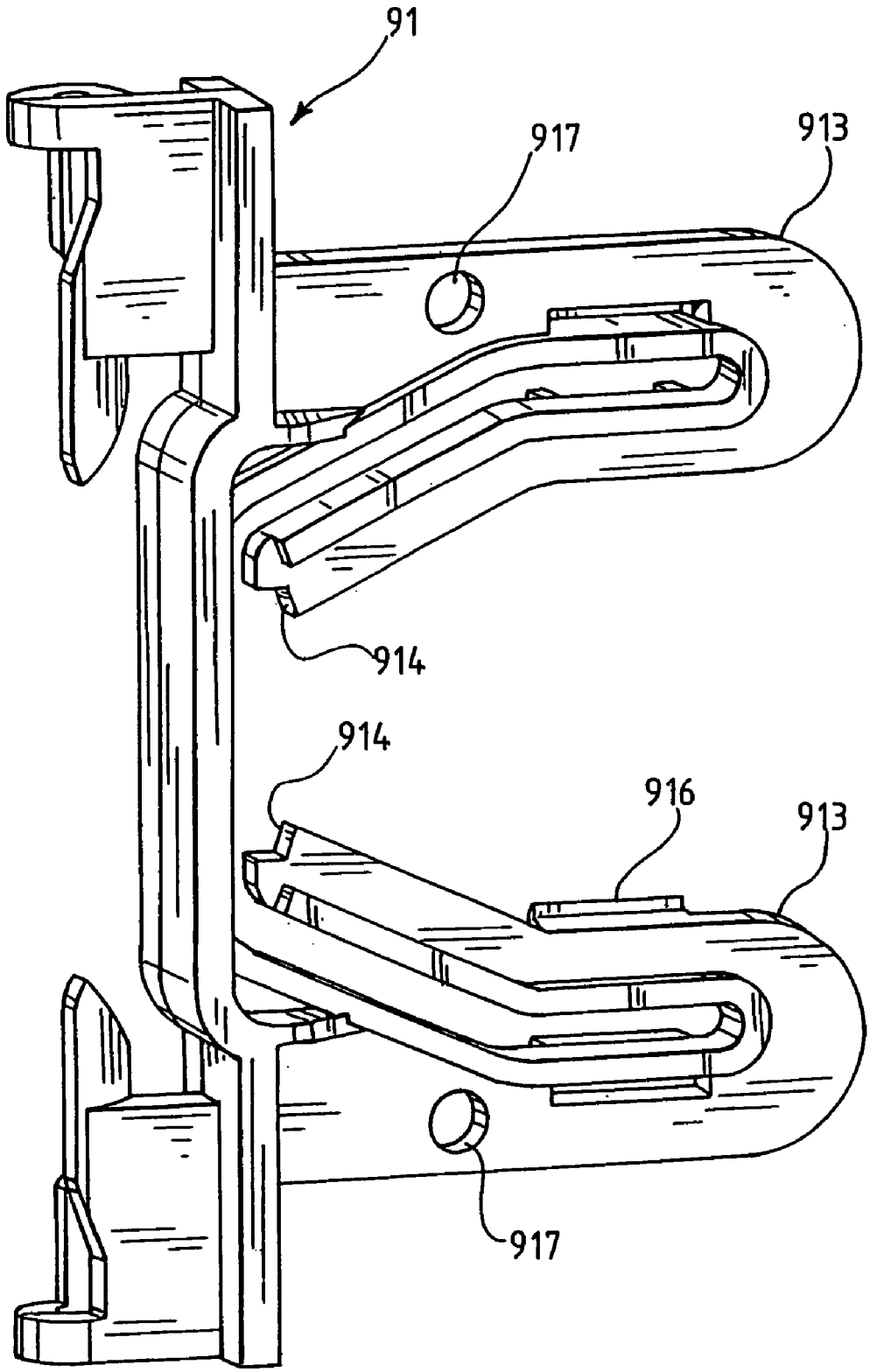
FIG. 33 is a perspective view of the stationary portion of the embodiment of FIG. 30.
Figure 34:
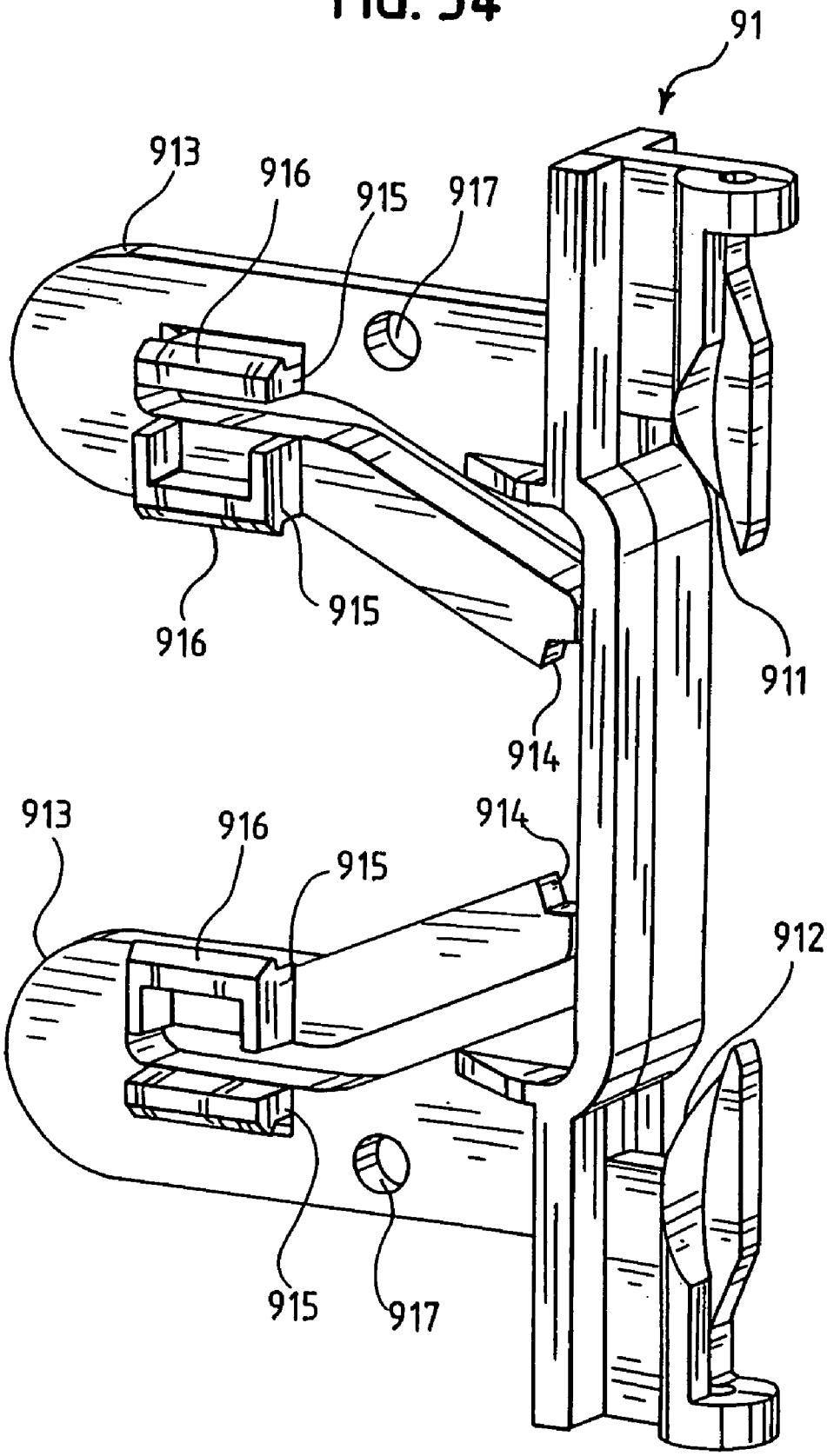
FIG. 34 is another perspective view of the stationary portion of the embodiment of FIG. 30.
Figure 35:
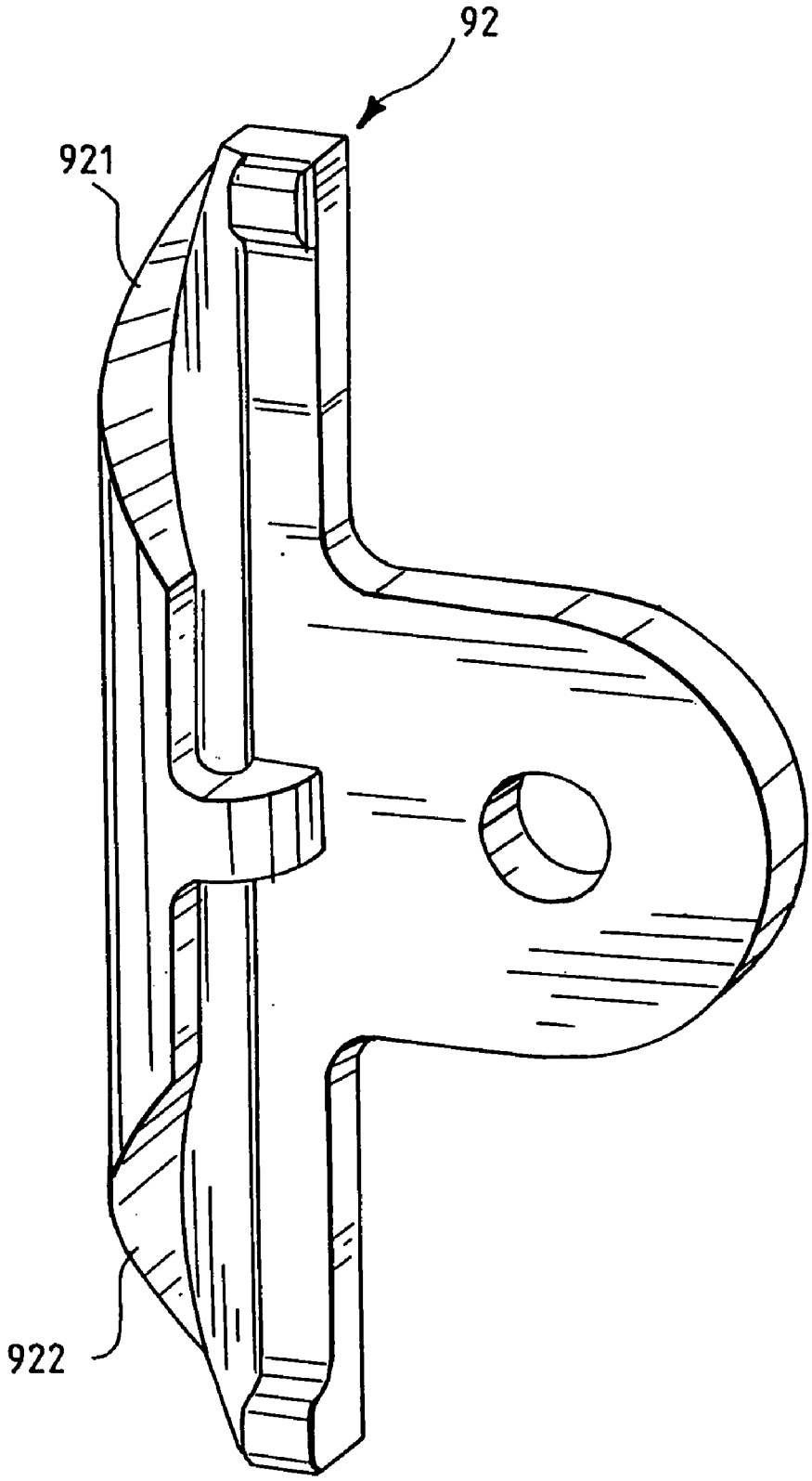
FIG. 35 is a perspective view of the rotating portion of the embodiment of FIG. 30.
Figure 36:
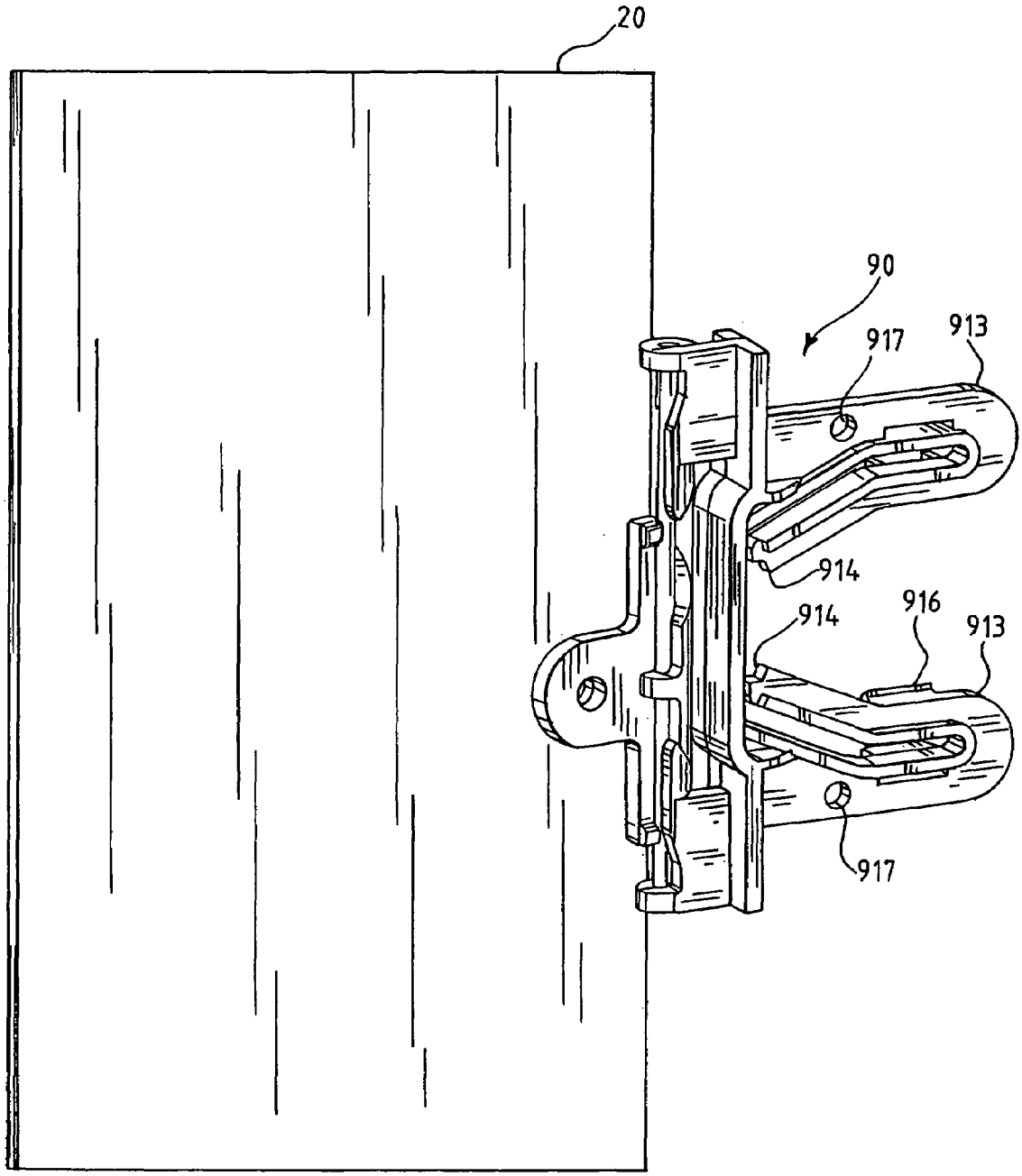
FIG. 36 is a perspective view of the embodiment of FIG. 30, showing a graphic display secured to the rotating portion.

FIGS. 30 through 39 illustrate another embodiment of a mounting element 90 comprising stationary portion 91, rotating portion 92, and hinge pin 93. FIG. 30 is a perspective view of the mounting element 90 in an initial stable orientation. FIG. 31 is a perspective view of the mounting element 90 after some rotation of the rotating portion 92, and FIG. 32 is a perspective view of the mounting element 90 after more rotation in the same direction. FIGS. 33 and 34 are perspective views of the stationary portion 91, and FIG. 35 is a perspective view of the rotating portion 92. FIG. 36 is a perspective view of the mounting element 90, showing a graphic display 20 secured to the rotating portion 92.

Figure 37:
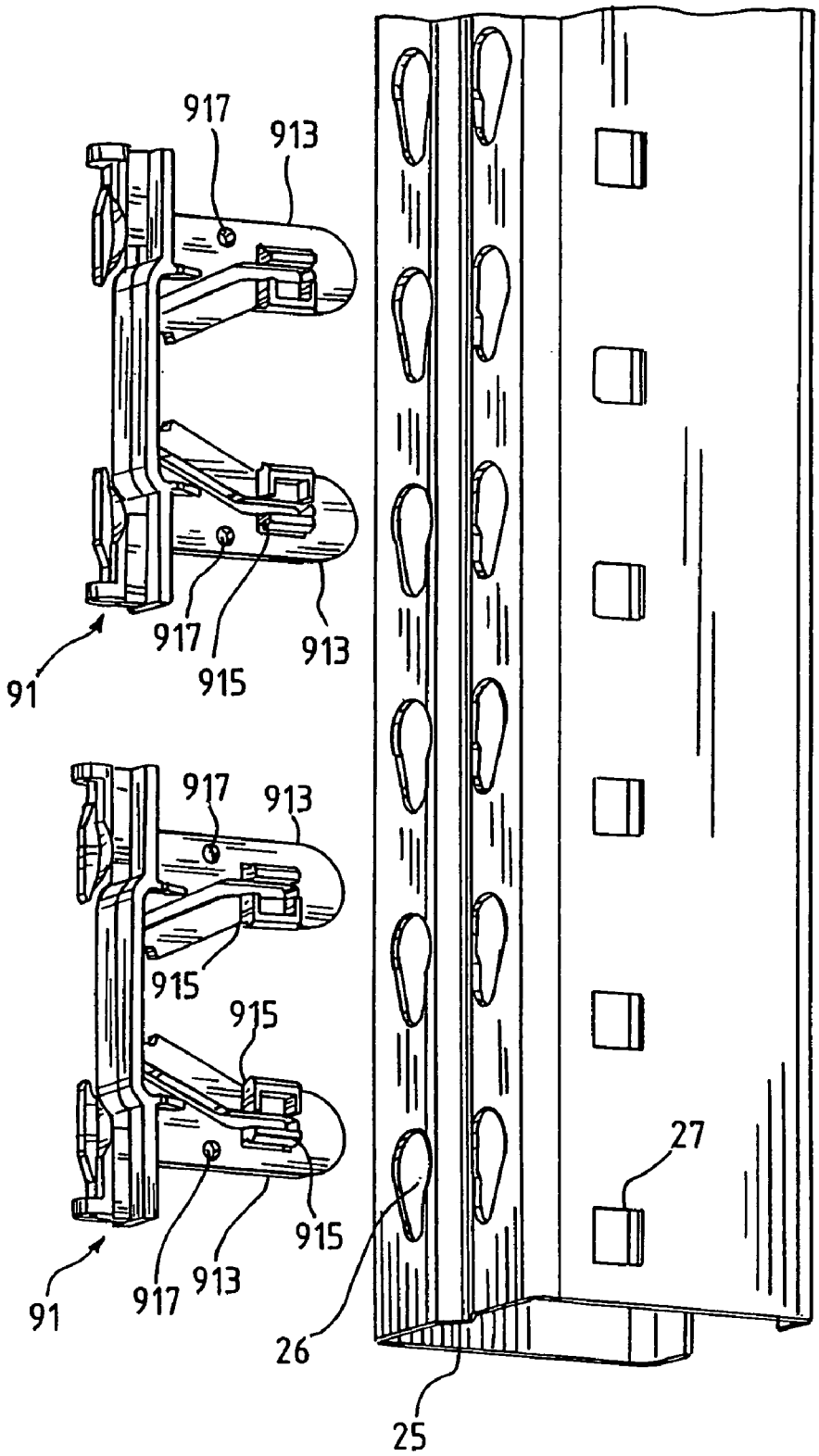
FIG. 37 is a perspective view, showing two stationary portions (of the embodiment of FIG. 30) disengaged from a supporting structure.
Figure 38:
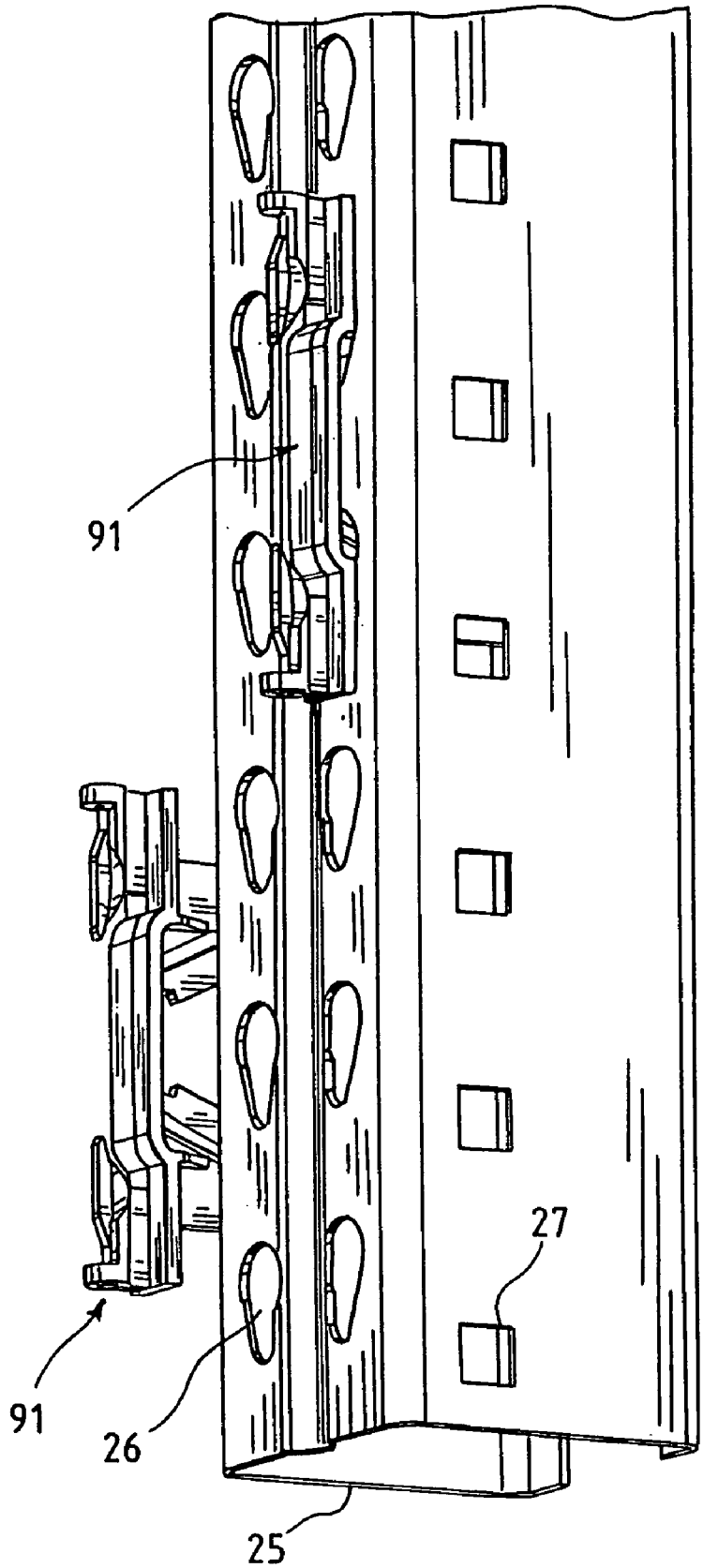
FIG. 38 is a perspective view, showing the two stationary portions of FIG. 37 secured to a supporting structure.
Figure 39:
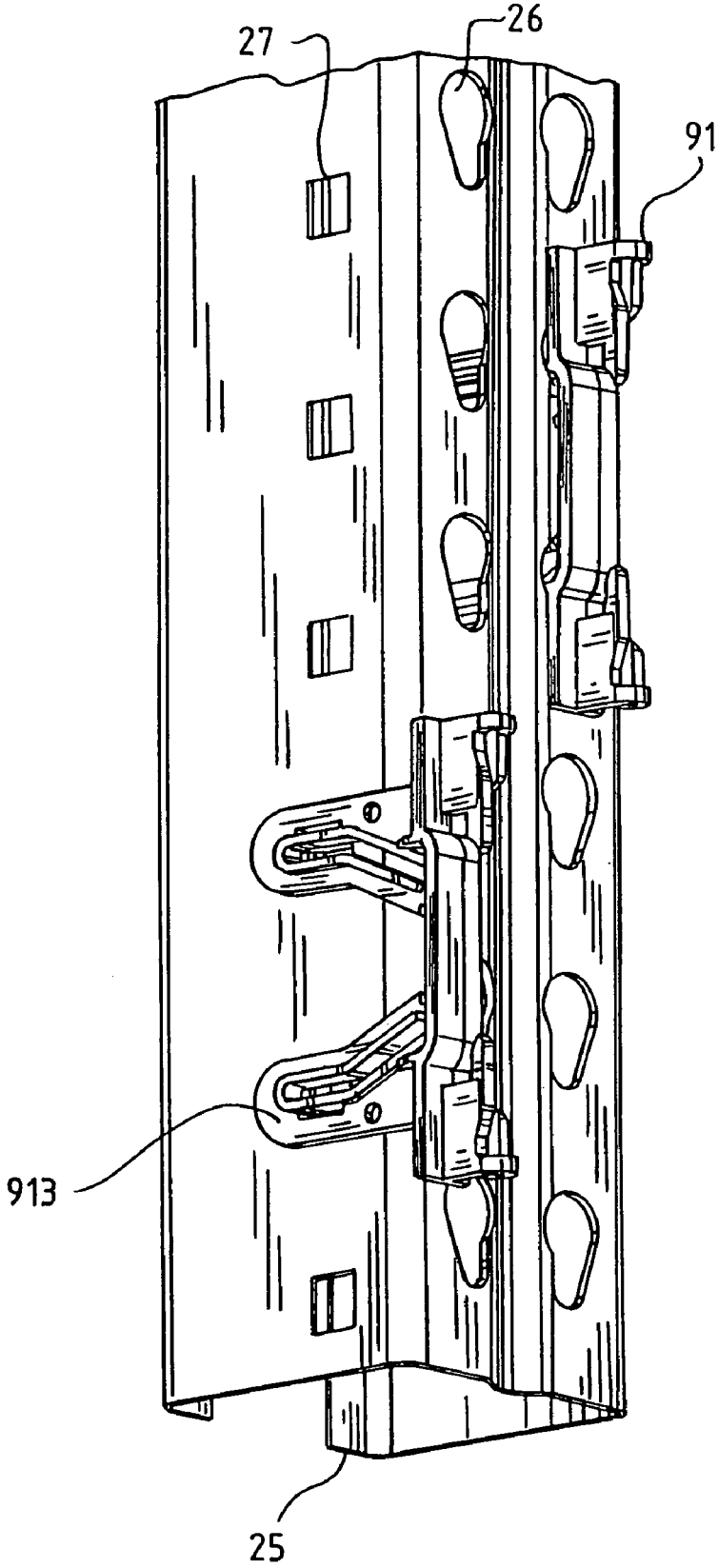
FIG. 39 is another perspective view, showing the two stationary portions of FIG. 37 secured to a supporting structure.

FIG. 37 is a perpective view of two stationary portions 91 disengaged from a supporting structure 25. FIGS. 38 and 39 are different perspective views of two stationary portions 91 secured to a supporting structure 25, one of them engaging teardrop openings 26 on the front of the supporting structure, and one of them engaging square openings 27 on the side of the supporting structure.

In the illustrated example, the stationary portion 91 is shown with multi-mount spring arms 913 to allow several ways of securing the mounting element 90 to a supporting structure 25. The free end of each of the spring arms 913 comprises a notch 914 for engaging edges of openings. In the illustrated example, two spring arms 913 can engage edges of two openings 26 on the front of a supporting structure 25, and can be pushed apart for easy disengagement.

In the illustrated example, each spring arm 913 also comprises a pair of mounting extensions 915, the outward surface of each extension 915 comprising a lip 916. This is best seen in FIGS. 34 and 37. The two lips 916 of a pair of extensions 915 can engage opposite edges of an opening 27 on the side of a supporting structure 25, and a pair of extensions 915 can be pushed together for easy disengagement. In other examples, only the one extension of each pair of extensions 915 comprises a lip 916. In still other examples, each spring arm 913 comprises only one mounting extension 915, and so forth.

In the illustrated example, each spring arm also comprises an opening 917, for securing the mounting element 90 to a supporting structure which does not have openings compatible with the any of the illustrated integral snaps (i.e., the spring arm notches 914 or the mounting extension lips 916). For example, screws or other fasteners could be used through the spring arm openings 917.

Like the example illustrated in FIGS. 27 through 29, the example illustrated in FIGS. 30 through 39 comprises two pair of helical sliding surfaces and uses gravity to achieve automatic return rotation. Stationary portion 91 comprises opposite stationary helical sliding surfaces 911 and 912, and rotating portion 92 comprises opposite rotating helical sliding surfaces 921 and 922.

In the illustrated example, stationary sliding surfaces 911 and 912 (as best seen in FIG. 34) are spaced apart from each other a greater distance than rotating sliding surfaces 921 and 922 (as best seen in FIG. 35) are spaced apart from each other. Therefore, either sliding surfaces 911 and 921 can slide against each other, or sliding surfaces 912 and 922 can slide against each other, depending on which side of mounting element 90 is lower.

As in the example illustrated in FIGS. 27 through 29, the relationship of the helical sliding surfaces in the example illustrated in FIGS. 30 through 39 will force rotating portion 92 to rise as it rotates. Consequently, rotating portion 92 will slide back down due to gravity, rotating in the other direction to its initial stable orientation. In other examples, there can be two rather than four engageable sliding surfaces. In still other examples, rotating sliding surfaces can be spaced apart from each other a greater distance than stationary sliding surfaces are spaced apart from each other.

FIGS. 40 through 43 illustrate another embodiment of a mounting element 94 comprising stationary portion 95 and a series of cascaded rotating portions 96. In the example of FIGS. 40 through 43, there are four rotating portions 96, each with a hinge pin 961, but a mounting element 94 can include a different number of rotating portions 96. Each rotating portion 96 includes a tab 967 to which a graphic display 20 can be secured. The respective graphic displays 20 can be rotated like pages in a book, and they will all automatically rotate back to their initial stable orientations with respect to the stationary portion 95 which can be secured to a support structure.

Figure 41:
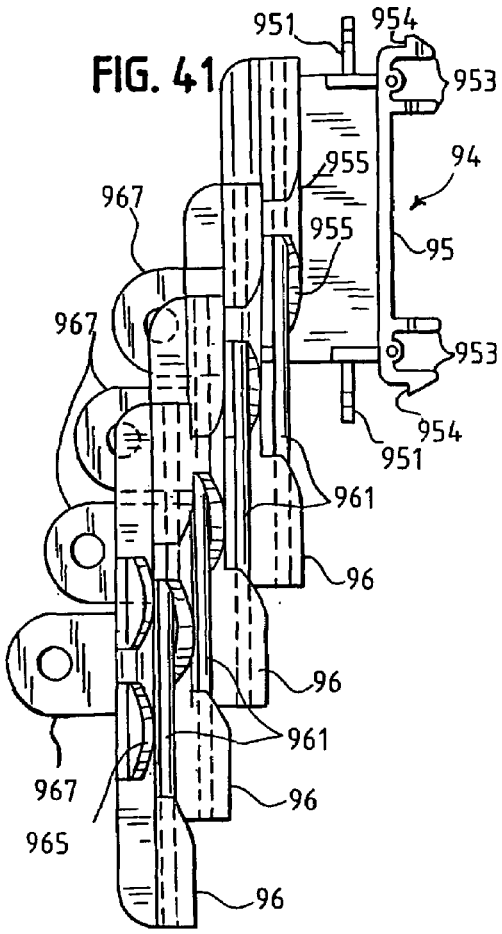
FIG. 41 is a front view of the embodiment of FIG. 40.
Figure 40:
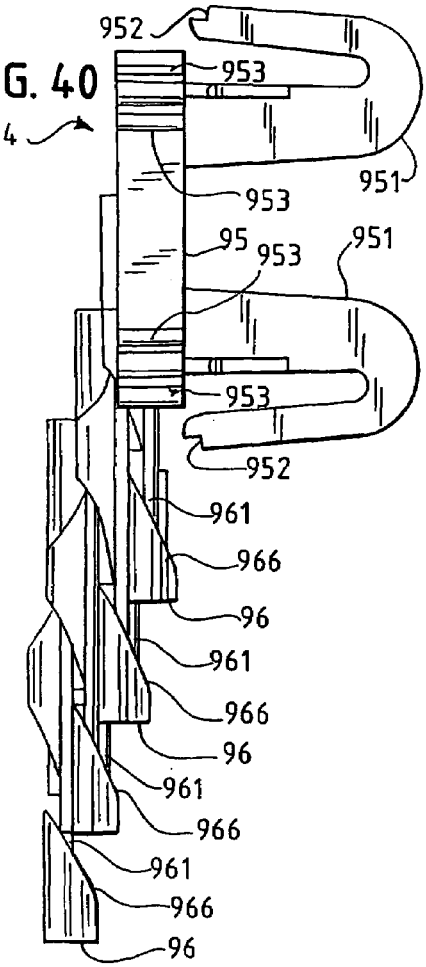
FIG. 40 is a side view of another embodiment of a mounting element.
Figure 42:
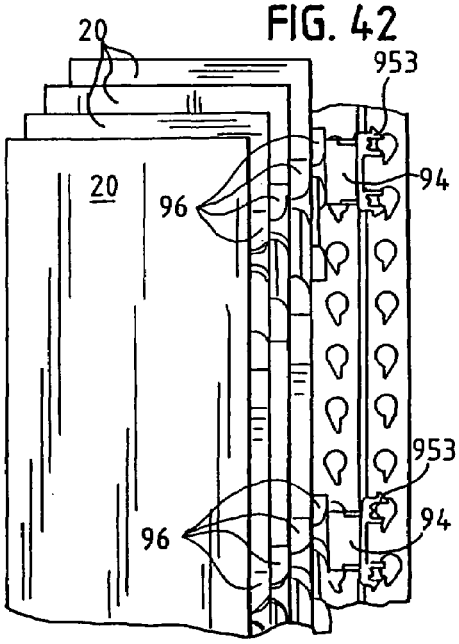
FIG. 42 is a perspective view of the embodiment of FIG. 40 in the initial orientation in one simulated environment.
Figure 43:
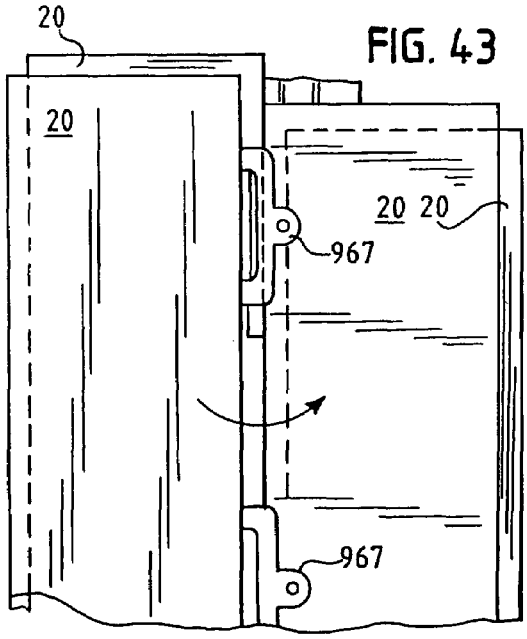
FIG. 43 is a perspective view of the embodiment of FIG. 40 after rotation of some rotating portions in one simulated environment.

FIG. 40 is a side view and FIG. 41 is a front view of the mounting element 94 in an initial stable orientation. FIG. 42 is a perspective view with four graphic displays 20, each secured respectively to a rotating portion 96 of each of two mounting elements 94. Each of the two mounting elements 94 is secured to a supporting structure 25. In FIG. 43, the bottom two graphic displays 20 have been rotated from their initial stable orientations with respect to the stationary portions 95.

In the illustrated embodiment of FIGS. 40 through 43, the stationary portion 95 allows several ways of securing the mounting element 94 to a supporting structure 25. The stationary portion 95 comprises spring arms 951, as best seen in FIG. 40. The free end of each of the spring arms 951 comprises a notch 952 for engaging edges of openings in the supporting structure 25. In the illustrated example, two spring arms 951 can engage edges of two openings on the front of a supporting structure 25, and can be pushed apart for easy disengagement.

In the illustrated example, each stationary portion 95 also comprises two pair of mounting extensions 953, as best seen in FIG. 41. The outermost surface of each pair of extensions 953 comprises a lip 954, for engaging edges of openings in the supporting structure 25. For example, extensions 953 can engage the edges of square openings on a support structure, and the surfaces with the lips 954 can be pushed toward each other for easy disengagement. In other examples, a different surface of each pair of extensions 953 can comprise a lip 954. In other examples, each of two surfaces of each pair of extensions 953 can comprise a lip 954.

Like the example illustrated in FIGS. 27 through 29, and the example illustrated in FIGS. 30 through 39, the example illustrated in FIGS. 40 through 43 comprises helical sliding surfaces and uses gravity to achieve automatic return rotation. However, the embodiment of FIGS. 40 through 43 comprises a series of cascaded rotating portions 96. A first rotating portion 96 can rotate with respect to stationary portion 95. A second rotating portion 96 can rotate with respect to the first rotating portion 96, a third one can rotate with respect to the second one, and so forth.

In the illustrated example, stationary portion 95 comprises opposite stationary helical sliding surfaces 955. Each rotating portion 96 comprises opposite helical sliding surfaces 966 and opposite helical sliding surfaces 965. Each pair of sliding surfaces 965 are substantially the same as the stationary helical sliding surfaces 955 of the stationary portion.

In the illustrated example, stationary sliding surfaces 955 are spaced apart from each other a smaller distance than the sliding surfaces 966 are spaced apart from each other. Therefore, only one of the sliding surfaces 966 (of the first rotating portion 96) can slide against only one of the stationary sliding surfaces 955, depending on which side of mounting element 94 is higher. Similarly, a sliding surface 966 of the second rotating portion 96 can slide against one of the sliding surfaces 965 of the first rotating portion 96, and so forth. In other examples, stationary sliding surfaces can be spaced apart from each other a greater distance than the sliding surfaces of the rotating portions, which engage those stationary sliding surfaces, are spaced apart from each other.

As in the example illustrated in FIGS. 27 through 29, and in the example illustrated in FIGS. 30 through 39, the relationship of the helical sliding surfaces in the example illustrated in FIGS. 40 through 43 will force each rotating portion 96 to rise as it rotates. Consequently, the rotating portions 96 can be rotated like the pages of a book are turned, and they will slide back down due to gravity, rotating in the other direction to their initial stable orientations.

In the embodiment of FIGS. 40 through 43, the mounting element 94 is reversible and can be mounted, for example, either so that the rotating portions 96 will rotate automatically to the left or so that they will rotate automatically to the right. In other examples without reversibility, there can be half as many engageable sliding surfaces for the same number of rotating portions.

From the foregoing it will be observed that numerous modifications and variations can be effectuated without departing from the true spirit and scope of the novel concepts of the present invention. It is to be understood that no limitation with respect to the specific embodiments illustrated is intended or should be inferred.

What is claimed is:

1. A sign-mounting system for mounting a graphic display to a supporting structure, the system comprising:

a stationary portion;

a rotating portion;

the rotating portion rotatably connected to the stationary portion;

the stationary portion further comprising at least two flexible spring arms;

each of the spring arms comprising a first segment;

the first segment comprising a fixed end;

the fixed end coupled with a remainder of the stationary portion;

each of the spring arms further comprising a second segment;

the first and second segments of each of the spring arms coupled at a bend in the spring arm;

the second segment comprising a free end;

a straight-line distance between the fixed end and the free end being less than a straight-line distance between the free end and the bend;

the second segment further comprising a notch;

each of the notches securingly engageable to an edge of an opening of the supporting structure;

the spring arms being sufficiently flexible to facilitate disengagement from the supporting structure;

the stationary portion further comprising at least one stationary helical sliding surface;

the rotating portion comprising at least one rotating helical sliding surface;

one, of the at least one stationary sliding surfaces, and one, of the at least one rotating sliding surfaces, sliding against each other, when the rotating portion is rotated from an initial stable orientation with respect to the stationary portion;

the rotating portion being moved longitudinally upward relative to the stationary portion, by force of the one, of the stationary sliding surfaces, and the one, of the rotating sliding surfaces, against each other when the rotating portion is rotated from the initial orientation;

the rotating portion being restored to the initial orientation, by force of the one, of the stationary sliding surfaces, and the one, of the rotating sliding surfaces, against each other, when the rotating portion is allowed to fall after being moved longitudinally upward.

2. The sign-mounting system as in claim 1, the at least two spring arms comprising symmetrically opposing spring arms, the symmetrically opposing spring arms securingly engageable to the supporting structure in either of at least two orientations with respect to the supporting structure.

3. The sign-mounting system as in claim 1, the at least two spring arms comprising a pair of symmetrically opposing first and second spring arms;

the first segment of the first spring arm spaced apart from the first segment of the second spring arm;

the first segment of the first spring arm positioned between the first segment of the second spring arm and the second segment of the first spring arm;

the first segment of the second spring arm positioned between the first segment of the first spring arm and the second segment of the second spring arm;

the first and second spring arms disengageable from the supporting structure, when the respective second segments of the first and second spring arms are pushed toward each other.

4. The sign-mounting system as in claim 1, the at least two spring arms comprising a pair of symmetrically opposing first and second spring arms;

the second segment of the first spring arm spaced apart from the second segment of the second spring arm;

the second segment of the first spring arm positioned between the second segment of the second spring arm and the first segment of the first spring arm;

the second segment of the second spring arm positioned between the second segment of the first spring arm and the first segment of the second spring arm;

the first and second spring arms disengageable from the supporting structure, when the respective second segments of the first and second spring arms are pushed away from each other.

5. A sign-mounting system for mounting a graphic display to a supporting structure, the system comprising:

a stationary portion;

a rotating portion;

the rotating portion rotatably connected to the stationary portion;

the stationary portion enabling at least two independent ways of securing the sign-mounting system to the supporting structure;

the stationary portion further comprising at least two spring arms;

each of the spring arms comprising a first segment;

the first segment comprising a fixed end;

the fixed end coupled with a remainder of the stationary portion;

each of the spring arms further comprising a second segment;

the first and second segments of each of the spring arms coupled at a bend in the spring arm;

the second segment comprising a free end;

the second segment further comprising a notch;

each of the notches securingly engageable to an edge of an opening of the supporting structure;

the securing engagement of the notches being a first one of the at least two independent ways of securing the sign-mounting system to the supporting structure;

the spring arms being sufficiently flexible to allow disengagement from the supporting structure;

the stationary portion further comprising at least one pair of first and second mounting extensions;

the first mounting extension facing and spaced apart from the second mounting extension;

the first and second extensions each comprising an outward surface;

at least one of the outward surfaces comprising a lip;

the lip securingly engageable to an edge of an opening of the supporting structure;

the securing engagement of the lip being a second one of the at least two independent ways of securing the sign-mounting system to the supporting structure;

the extensions being sufficiently flexible to allow disengagement from the supporting structure.

6. The sign-mounting system as in claim 5, the at least one pair of first and second mounting extensions comprising at least two pair of first and second mounting extensions.

7. The sign-mounting system as in claim 5, each of at least two of the at least two spring arms comprising at least one of the mounting extensions.

8. The sign-mounting system as in claim 5, at least one of the at least two spring spring arms comprising the at least one pair of first and second mounting extensions.

9. The sign-mounting system as in claim 8, the first segment of the at least one spring arm comprising the first mounting extension;

the second segment of the at least one spring arm comprising the second mounting extension.

10. The sign-mounting system as in claim 8, the stationary portion further comprising at least one interior edge defining an opening;

the stationary portion mountable to the supporting structure, using a fastener extending through the opening of the stationary portion.

11. The sign-mounting system as in claim 5, further comprising:

a spring;

the spring being put in tension when the rotating portion is rotated from an initial stable orientation with respect to the stationary portion;

the spring being sufficiently resilient, after being put in tension, to restore the rotating portion to the initial orientation.

12. The sign-mounting system as in claim 11, the spring being a torsion spring;

a first end of the spring coupled to the stationary portion;

a second end of the spring coupled to the rotating portion.

13. The sign-mounting system as in claim 11, the spring being a compression spring.

14. The sign-mounting system as in claim 11, the stationary portion further comprising a stationary helical sliding surface;

the rotating portion comprising a rotating helical sliding surface;

the stationary and rotating helical sliding surfaces sliding against each other, when the rotating portion is rotated from the initial orientation;

the rotating portion being moved longitudinally relative to the stationary portion, by force of the stationary and rotating sliding surfaces against each other when the rotating portion is rotated from the initial orientation;

the spring being put in tension by longitudinal movement of the rotating portion, when the rotating portion is rotated from the initial orientation.

15. The sign-mounting system as in claim 5, further comprising:

a bent arm spring;

a first end of the bent arm spring coupled to the stationary portion;

a second end of the bent arm spring coupled to the rotating portion;

the bent arm spring being temporarily deformed into tension from an initial stable shape, when the rotating portion is rotated from an initial stable orientation with respect to the stationary portion;

the bent arm spring being sufficiently resilient to return to the initial shape after being temporarily deformed, restoring the rotating portion to the initial orientation.

16. The sign-mounting system as in claim 15, further comprising:

a hinge pin;

a pivot pin;

the hinge pin rotatably connecting the rotating portion and the stationary portion;

the pivot pin pivotally coupling the second end of the bent arm spring to the rotating portion;

a knuckle extending at least part way around the hinge pin;

the bent arm spring being temporarily stretched from the initial shape, when the rotating portion is rotated from the initial orientation;

the knuckle preventing the pivot pin from over-centering when the rotating portion is rotated from the initial orientation.

17. The sign-mounting system as in claim 5, a cam;

a flexible tongue;

the tongue comprising a fixed end;

the tongue further comprising a free end;

the cam and the tongue sliding relative to each other, when the rotating portion is rotated from an initial stable orientation with respect to the stationary portion;

the free end of the tongue being displaced from an initial stable position relative to the fixed end of the tongue, by force of the cam and the tongue sliding against each other when the rotating portion is rotated from the initial orientation;

the tongue being put in tension by displacement of the free end of the tongue, when the rotating portion is rotated from the initial orientation;

the tongue being sufficiently resilient to return the free end to the initial position after being temporarily displaced, restoring the rotating portion to the initial orientation by force of the cam and the tongue sliding against each other.

18. The sign-mounting system as in claim 17, the stationary portion further comprising the flexible tongue;

the rotating portion comprising the cam.

19. The sign-mounting system as in claim 5, the stationary portion further comprising a stationary helical sliding surface;

the rotating portion comprising a rotating helical sliding surface;

the stationary and rotating helical sliding surfaces sliding against each other, when the rotating portion is rotated from an initial stable orientation with respect to the stationary portion;

one, of the stationary and rotating portions, being temporarily deformed out of an initial stable shape, by force of the stationary and rotating sliding surfaces against each other when the rotating portion is rotated from the initial orientation;

the one, of the stationary and rotating portions, being sufficiently resilient to return to the initial shape after being temporarily deformed, restoring the rotating portion to the initial orientation by force of the stationary and rotating sliding surfaces against each other.

20. The sign-mounting system as in claim 19, the stationary portion further comprising a middle hinge segment;

the stationary portion further comprising two outer hinge segments;

the rotating portion further comprising two rotating hinge segments;

the rotating hinge segments rotatably connected to the middle and outer hinge segments;

the rotating helical sliding surface comprising at least two rotating helical sliding surfaces;

each of the rotating hinge segments comprising at least one of the at least two rotating helical sliding surfaces;

the stationary helical sliding surface comprising at least two stationary helical sliding surfaces;

each of the outer hinge segments comprising at least one of the at least two stationary helical sliding surfaces;

the two outer hinge segments temporarily being spread further away from the middle hinge segment when the rotating portion is rotated from the initial orientation.

21. The sign-mounting system as in claim 1, further comprising:

a hinge pin;

the hinge pin rotatably connecting the rotating portion and the stationary portion;

the rotating portion longitudinally movable along an axis of the hinge pin.

22. The sign-mounting system as in claim 1, the at least one stationary helical sliding surface comprising first and second stationary sliding surfaces;

the at least one rotating helical sliding surface comprising first and second rotating sliding surfaces;

the first rotating sliding surface engageable with the first stationary sliding surface;

the second rotating sliding surface engageable with the second stationary sliding surface;

the one, of the stationary sliding surfaces, and the one, of the rotating sliding surfaces, which slide against each other when the rotating portion is rotated, being determined by an orientation of the stationary portion with respect to the supporting structure.

23. The sign-mounting system as in claim 22, the first and second stationary sliding surfaces spaced apart from each other a generally greater distance than the first and second rotating sliding surfaces are spaced apart from each other.

24. The sign-mounting system as in claim 22, the first and second rotating sliding surfaces spaced apart from each other a generally greater distance than the first and second stationary sliding surfaces are spaced apart from each other.

25. The sign-mounting system as in claim 1, the stationary portion being formed of polypropylene.

26. The sign-mounting system as in claim 5, further comprising means for automatically restoring the rotating portion to an initial stable orientation with respect to the stationary portion, after the rotating portion is rotated from the intial orientation.

* * * * *

UNITED STATES PATENT AND TRADEMARK OFFICE

CERTIFICATE OF CORRECTION

PATENT NO. : 7,284,740 B2
APPLICATION NO. : 11/448422
DATED : October 23, 2007
INVENTOR(S) : Padiak et al.

It is certified that error appears in the above-identified patent and that said Letters Patent is hereby corrected as shown below:

In claim 10 (col. 13, line 15), delete "claim 8," and insert therefore --claim 1,--.

Signed and Sealed this

Twenty-sixth Day of February, 2008

JON W. DUDAS
*Director of the United States Patent and Trademark Office*